US009971297B2

(12) United States Patent
Mimura et al.

(10) Patent No.: US 9,971,297 B2
(45) Date of Patent: May 15, 2018

(54) IMAGE FORMING APPARATUS INCLUDING TONER CONTAINER AND TONER CONTAINER ATTACHMENT PART

(71) Applicant: KYOCERA Document Solutions Inc., Osaka (JP)

(72) Inventors: Daisuke Mimura, Osaka (JP); Tomohiro Sue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/428,382

(22) Filed: Feb. 9, 2017

(65) Prior Publication Data

US 2017/0235273 A1 Aug. 17, 2017

(30) Foreign Application Priority Data

Feb. 15, 2016 (JP) ..... 2016-025747

(51) Int. Cl.
*G03G 15/08* (2006.01)
*G03G 21/16* (2006.01)
*G03G 21/18* (2006.01)

(52) U.S. Cl.
CPC ..... *G03G 21/1676* (2013.01); *G03G 15/0863* (2013.01); *G03G 15/0865* (2013.01); *G03G 21/1633* (2013.01); *G03G 21/1896* (2013.01)

(58) Field of Classification Search
CPC ..... G03G 15/0863; G03G 15/0865; G03G 21/1676
See application file for complete search history.

(56) References Cited

U.S. PATENT DOCUMENTS 5,329,340 A * 7/1994 Fukuchi ..... G03G 15/0822 222/DIG. 1
5,530,531 A * 6/1996 Girard ..... B41J 2/1755 222/DIG. 1
6,006,046 A * 12/1999 MacFarland ..... G03G 15/0855 141/364
6,505,006 B1 * 1/2003 Solanki ..... B41J 2/1755 399/12
8,929,779 B2 1/2015 Takami et al.
9,128,415 B2 9/2015 Takami et al.
9,329,529 B2 5/2016 Takami et al.
9,541,862 B2 1/2017 Takami et al.
2004/0203413 A1 * 10/2004 Harumoto ..... B41J 2/17546 455/66.1
2005/0196198 A1 * 9/2005 Kawamura ..... G03G 15/0872 399/262
2007/0122205 A1 * 5/2007 Taguchi ..... G03G 15/0872 399/258

(Continued)

FOREIGN PATENT DOCUMENTS

JP 2012-018377 A 1/2012

*Primary Examiner* — David Bolduc
(74) *Attorney, Agent, or Firm* — Studebaker & Brackett PC

(57) ABSTRACT

An image forming apparatus includes an attachment part to which a toner container is detachably attached. The toner container has a main body and a non-compatible shape discriminating piece. In the main body, a toner is contained. The non-compatible shaped piece is capable of being assembled into the main body and has a shape different for each kind of the toner container. The attachment part has a non-compatible shape discriminating member capable of engaging with the non-compatible shaped piece.

10 Claims, 19 Drawing Sheets

(56) References Cited

U.S. PATENT DOCUMENTS

| | | | | |
|---|---|---|---|---|
| 2007/0189781 | A1* | 8/2007 | Katogi | G03G 15/0863 399/12 |
| 2008/0175629 | A1* | 7/2008 | Eto | G03G 15/0875 399/262 |
| 2009/0257774 | A1* | 10/2009 | Rummler | G03G 15/0875 399/109 |
| 2010/0129118 | A1* | 5/2010 | Kimura | G03G 15/0872 399/260 |
| 2010/0322666 | A1* | 12/2010 | Inomata | G03G 15/0896 399/120 |
| 2011/0058857 | A1* | 3/2011 | Hori | G03G 15/0867 399/262 |
| 2011/0123229 | A1* | 5/2011 | Takashima | G03G 21/1676 399/254 |
| 2011/0255881 | A1* | 10/2011 | Lee | G03G 15/0121 399/12 |
| 2011/0293294 | A1* | 12/2011 | Eto | G03G 15/0863 399/12 |
| 2012/0106985 | A1* | 5/2012 | Tanaka | G03G 15/0863 399/12 |
| 2012/0195645 | A1* | 8/2012 | Takami | G03G 15/0886 399/262 |
| 2012/0321341 | A1* | 12/2012 | Hori | G03G 15/0881 399/110 |
| 2015/0086242 | A1* | 3/2015 | Tsuchiya | G03G 15/0886 399/258 |
| 2015/0227079 | A1* | 8/2015 | Wakimoto | G03G 15/0886 399/258 |
| 2016/0004184 | A1* | 1/2016 | Kikuchi | G03G 15/0872 399/258 |
| 2017/0023879 | A1* | 1/2017 | Murata | G03G 15/0879 |

* cited by examiner

IMAGE FORMING APPARATUS INCLUDING TONER CONTAINER AND TONER CONTAINER ATTACHMENT PART

INCORPORATION BY REFERENCE

This application is based on and claims the benefit of priority from Japanese Patent application No. 2016-025747 filed on Feb. 15, 2016, which is incorporated by reference in its entirety.

BACKGROUND

The present disclosure relates to an image forming apparatus having a toner container which is detachably attached.

In an electrophotographic type image forming apparatus, a latent image formed on an image carrier is developed into a toner image by a development device. If an amount of toner in the development device decreases to a predetermined amount or less, a toner is supplied to the development device from a toner container. The toner container is detachably attached to an attachment part of an apparatus main body.

The image forming apparatuses may be sold at different prices depending on a selling area even if they are the same machine model. In this case, although the toner containers are used in common for the image forming apparatuses of different prices, different kinds of toner are stored in the toner containers in order to meet the different prices. If the toner containers are used in common, an attachment failure of the toner container to the apparatus main body may easily occur. In order to prevent such an attachment failure, the image forming apparatus may have a configuration such that a non-compatible shaped part having a shape different for each kind of toner is provided in the toner container while a non-compatible shape discriminating member with which the non-compatible shaped part can be engaged is provided in the apparatus main body. By engaging the non-compatible shaped part with the non-compatible shape discriminating member, it is discriminated that a normal toner container is attached to the apparatus main body.

However, in the image forming apparatus, because it is necessary to form the non-compatible shaped part for different kinds of the toner, productivity of the toner container may be low.

In addition, for a dye to mold the toner container, a nesting type dye having a dye for molding a main body and another dye for molding the non-compatible shaped part is used in many cases. Because the non-compatible shaped parts have a small difference in size and position and have a plurality of kinds, a wrong type dye may be used at the molding or it may be difficult to accurately manage the number of the toner containers in a production factory.

SUMMARY

In accordance with an embodiment of the present disclosure, an image forming apparatus includes an attachment part to which a toner container is detachably attached. The toner container has a main body and a non-compatible shape discriminating piece. In the main body, a toner is contained. The non-compatible shaped piece is capable of being assembled into the main body and has a shape different for each kind of the toner container. The attachment part has a non-compatible shape discriminating member capable of engaging with the non-compatible shaped piece.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
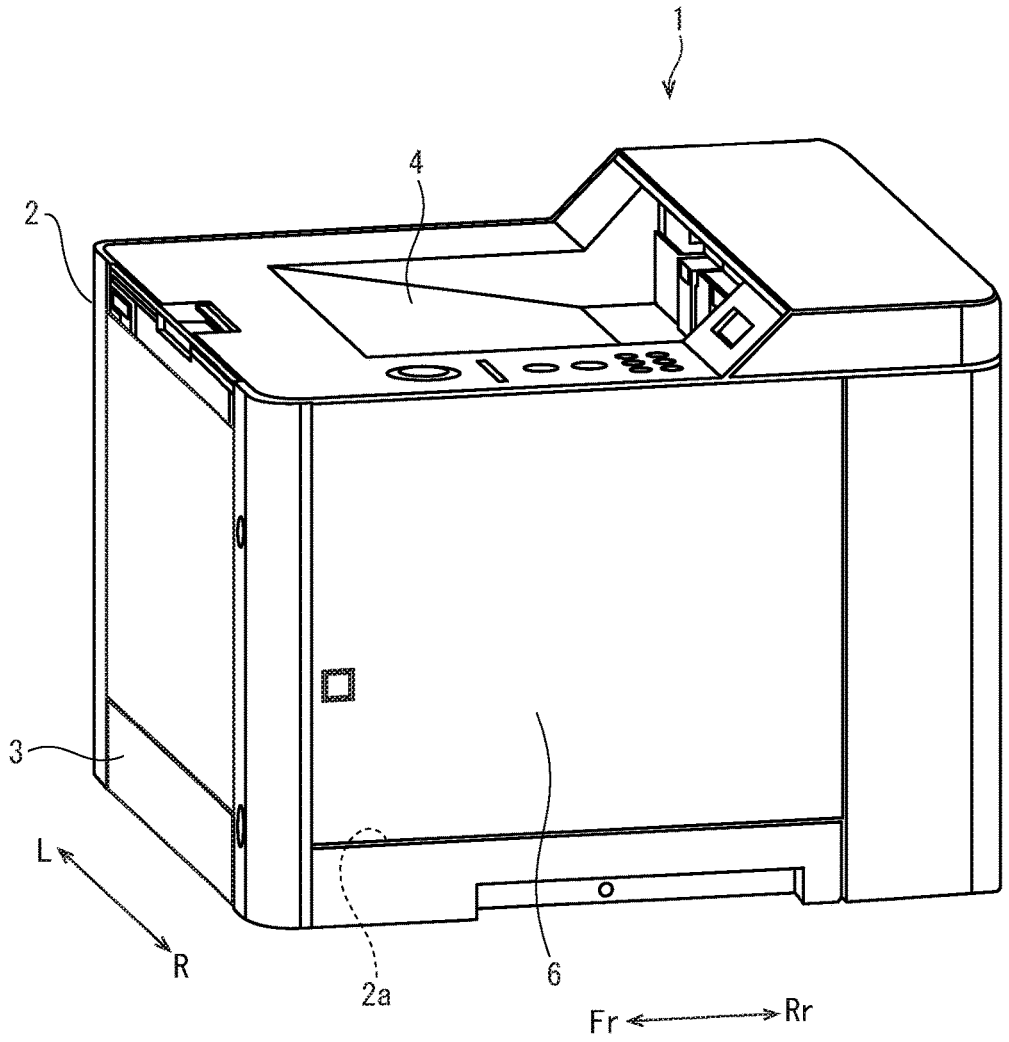
FIG. 1 is a perspective view showing a color printer according to an embodiment of the present disclosure.
Figure 2:
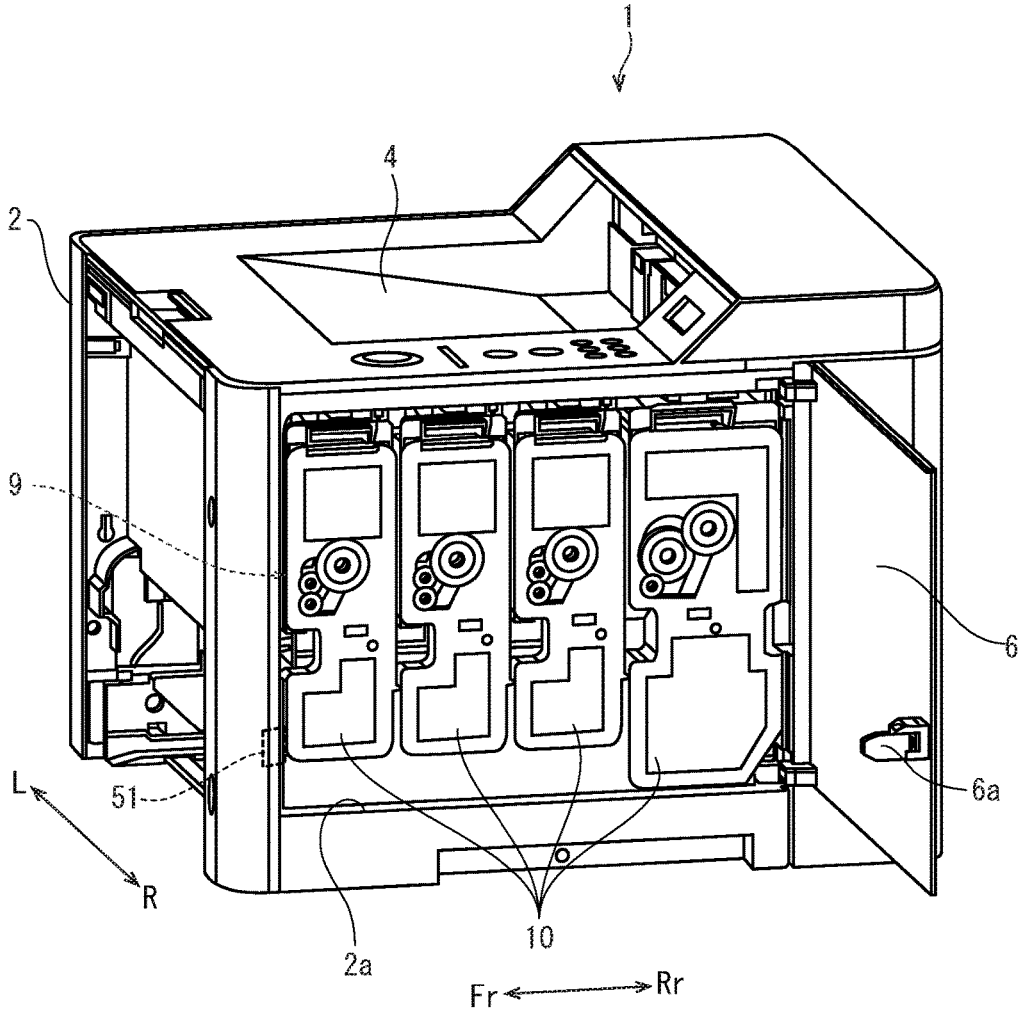
FIG. 2 is a perspective view showing a toner container attachment opening to which a toner container is attached, in the color printer according to the embodiment of the present disclosure.

With reference to FIGS. 1 and 2, a color printer 1 that is an image forming apparatus will be described. FIG. 1 is a perspective view showing the color printer and FIG. 2 is a perspective view showing the color printer whose toner container attachment opening is opened. In the following description, front and rear directions shown in FIG. 1 show front and rear directions of the color printer, and left and right directions are based on a direction in which the color printer is viewed from the front side. In each figure, Fr, Rr, L and R show a front side, a rear side, a left side and a right side, respectively.

As shown in FIG. 1, the color printer 1 has a rectangular parallelepiped shaped apparatus main body 2. In a lower portion of the apparatus main body 2, a sheet feeding cassette 3 is attached. On an upper face of the apparatus main body 2, an ejection tray 4 is formed. The apparatus main body 2 has an image forming part, a sheet conveying path and a control part. The image forming part forms an image on a sheet using toner of four colors by an electrophotographic manner. The sheet conveying path is formed from the sheet feeding cassette 3 to the ejection tray 4 through the image forming part. The control part controls an image forming operation of the image forming part and a sheet conveying operation of the sheet conveying path such that the sheet fed from the sheet feeding cassette 3 is conveyed along the sheet conveying path, an image is formed on the sheet by the image forming part and then the sheet is ejected on the ejection tray 4.

As shown in FIG. 2, on a right side face of the apparatus an body 2, a toner container attachment opening 2*a* of a horizontally long rectangular shape is formed. The toner container attachment opening 2*a* is closed and opened by a cover 6. At a front end portion on an inner face of the cover 6, a pressing piece 6*a* is protruded. Inside of the toner container attachment opening 2*a*, a toner container attachment part 9 to which a toner container 10 containing toner (developer) of each color is detachably attached is provided.

Figure 3A:
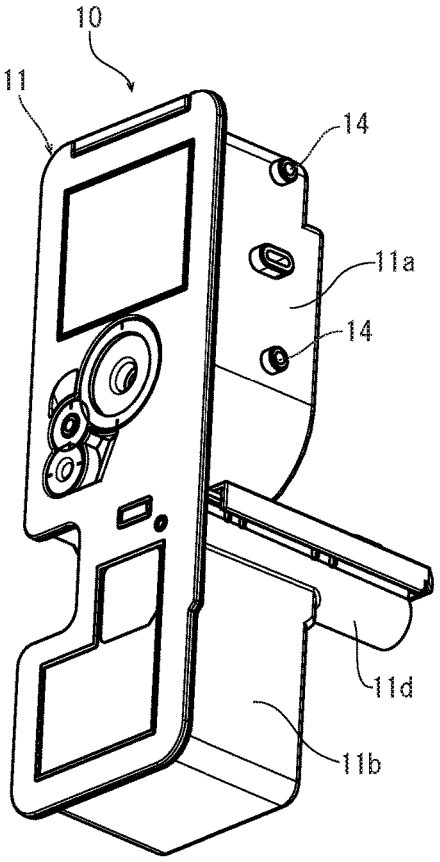
FIG. 3A is a perspective view showing the toner container viewed from a front side, in the color printer according to the embodiment of the present disclosure.
Figure 3B:
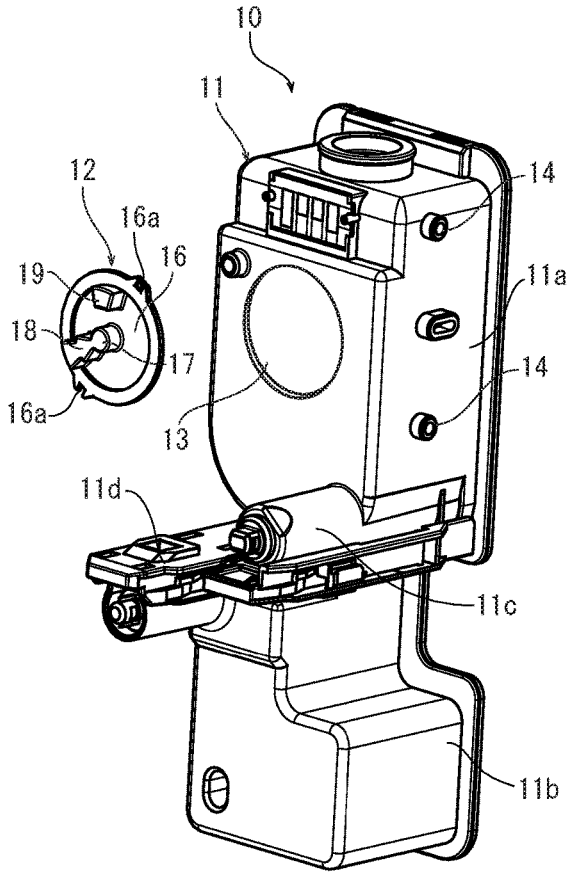
FIG. 3B is a perspective view showing the toner container viewed from a rear side, in the color printer according to the embodiment of the present disclosure.

As shown in FIGS. 3A and 3B, the toner container 10 will be described. FIG. 3A is a perspective view showing the toner container viewed from the front side and FIG. 3B is a disassembled perspective view showing the toner container viewed from the rear side.

The toner container 10 includes a main body 11 in which the toner is contained and a non-compatible shaped piece 12 (refer to FIG. 3B) which discriminates the kinds of the toner container 10 (the kinds of the toner). The main body 11 has an upper toner containing part 11*a* in which the toner to be supplied to the image forming part is contained and a lower toner collecting part 11*b* in which a waste toner discharged from the image forming part is collected. On a rear face of the toner containing part 11*a*, a circular recess 13 is formed. Furthermore, from the rear face of the toner containing part 11*a*, a toner replenishment duct 11*c* is protruded. Through the toner replenishment duct 11*c*, the toner is supplied to the image forming part. On both side faces of the toner containing part 11*a*, two bosses 14 are protruded at a predetermined interval in a vertical direction. From a rear face of the toner collecting part 11*b*, a toner collecting duct 11*d* is protruded. Through the toner collecting duct 11*d*, the waste toner is collected from the image forming part.

As shown in FIG. 3B, the non-compatible shaped piece 12 has a click shaped base part 16. On a center of one face of the base part 16, a shaft 17 is protruded. On the one face of the base part 16, a first engagement projection 18 and a second engagement projection 19 that are discriminated parts each having a shape different for each toner container 10 are protruded at a predetermined interval along a circumferential direction of a circle around the shaft 17. The first engagement projection 18 has a substantially fan shape around the shaft 17 and protrudes radially from a circumferential face of the shaft 17. In detail, the first engagement projection 18 has a shape in which two fan shaped portions around the shaft 17 are arranged radially from the circumferential face of the shaft 17. The second engagement projection 19 has a substantially fan shape around the shaft 17 and is arranged separately from the shaft 17 in the radial direction.

Two positioning projections 16*a* are diagonally formed on a circumference of the base part 16. By corresponding the positioning projections 16*a* to positioning recesses (not shown) formed in the recess 13 of the main body 11, the non-compatible shaped piece 12 is positioned to the main body 11 and then the base part 16 is assembled to the recess 13 by adhesion, a double-sided tape or welding. By varying a position of the positioning projections 16*a* with respect to the recess 13, various non-compatible shapes can be generated.

Next, the toner container attachment part 9 will be described with reference to FIG. 2 and FIGS. 4 to 11. FIG.

Figure 5:
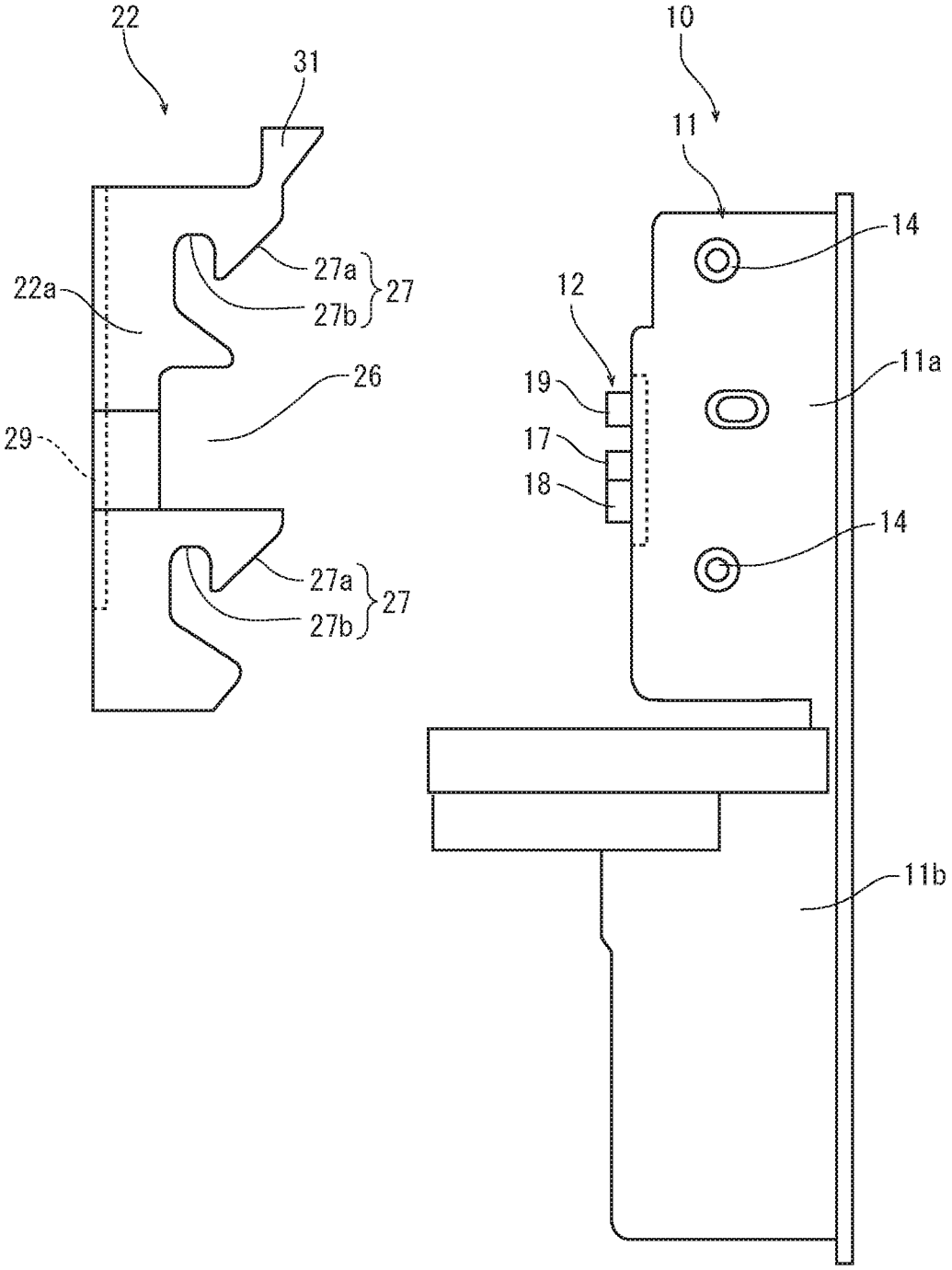
FIG. 5 is a side view showing the toner container and the container holder, in the color printer according to the embodiment of the present disclosure.
Figure 6A:
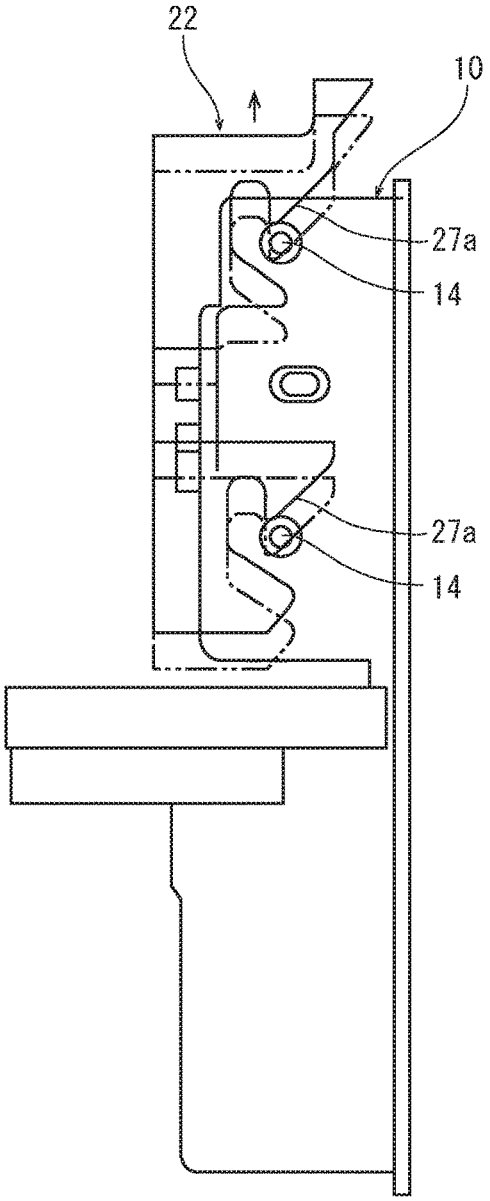
FIG. 6A is a side view showing the container holder in a middle of attaching the toner container, in the color printer according to the embodiment of the present disclosure.
Figure 7:
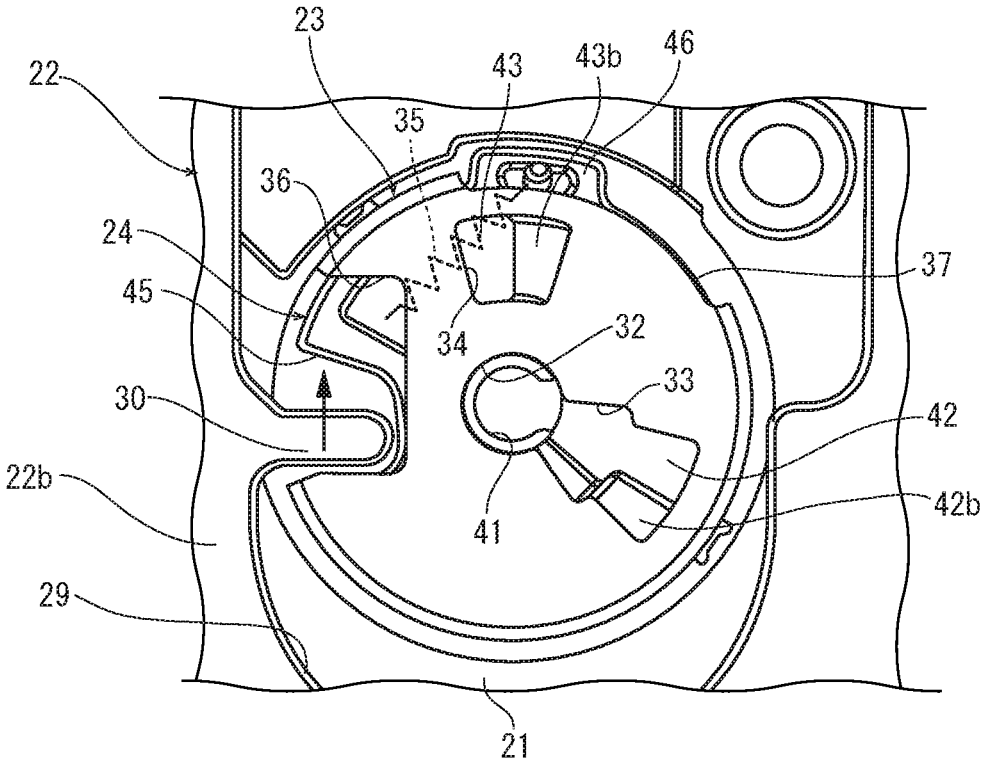
FIG. 7 is a front view showing a non-compatible shape discriminating member and an actuating member before a main body of the toner container is attached, in the color printer according to the embodiment of the present disclosure.
Figure 8:
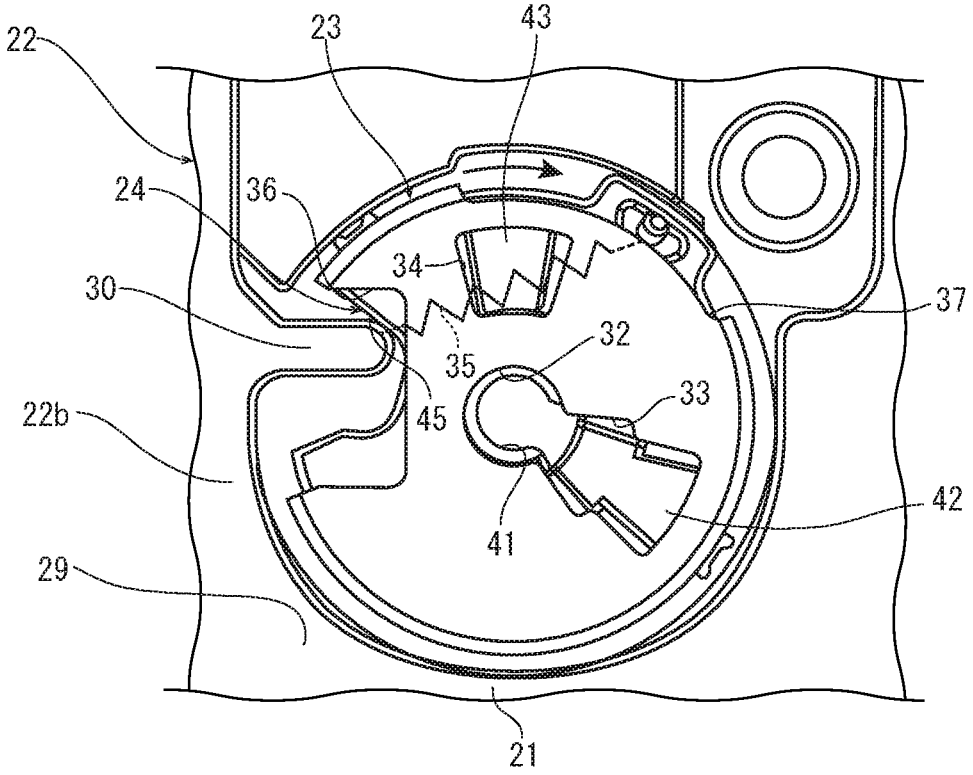
FIG. 8 is a front view showing the non-compatible shape discriminating member and the actuating member in a middle of attaching the main body of the toner container, in the color printer according to the embodiment of the present disclosure.
Figure 9:
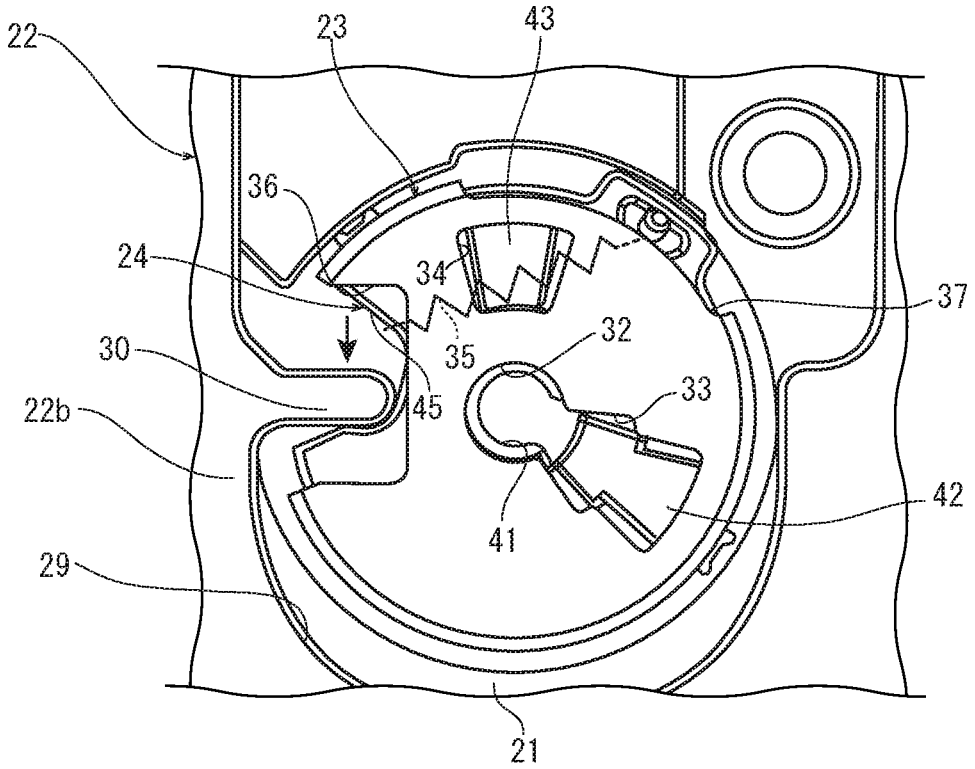
FIG. 9 is a front view showing the non-compatible shape discriminating member and the actuating member after the main body of the toner container is attached, in the color printer according to the embodiment of the present disclosure.
Figure 10:
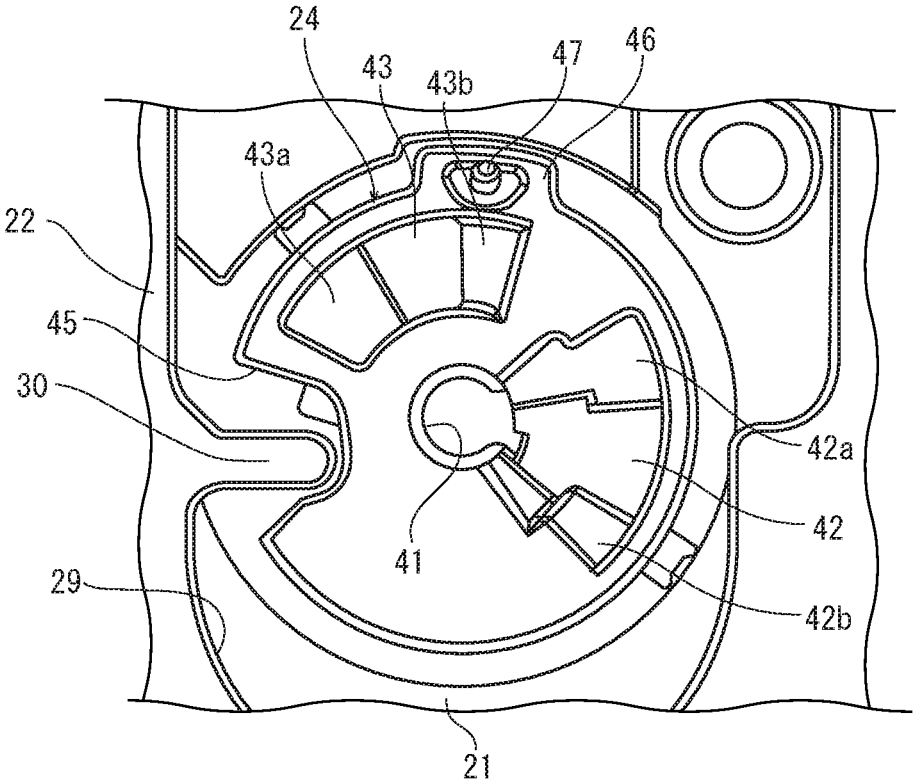
FIG. 10 is a front view showing the actuating member, in the color printer according to the embodiment of the present disclosure.
Figure 11A:
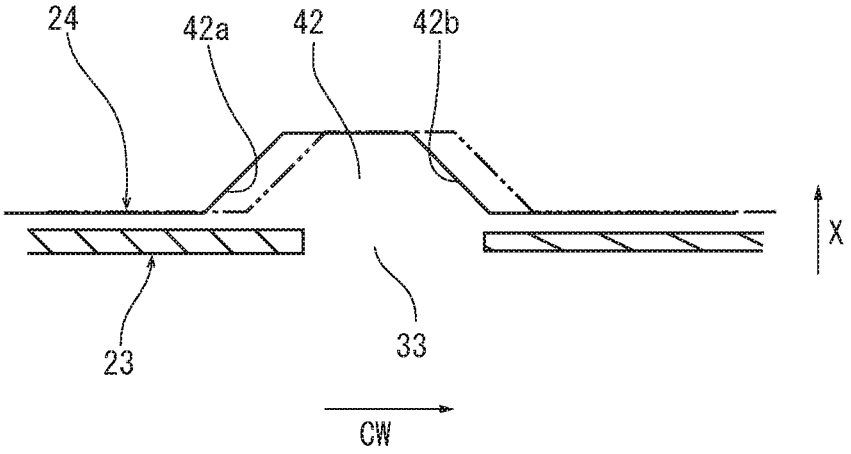
FIG. 11A is a sectional side view showing a first recess of the actuating member, in the color printer according to the embodiment of the present disclosure.
Figure 11B:
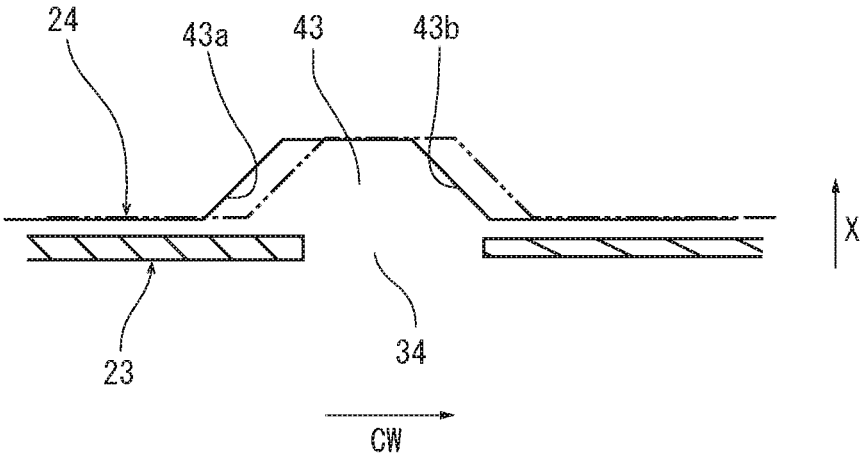
FIG. 11B is a sectional side view showing a second recess of the actuating member, in the color printer according to the embodiment of the present disclosure.

4 is a perspective view showing a container holder, FIG. 5 is a side view showing the container holder and the toner container, FIG. 6 is a view showing the container holder moved when the toner container is attached. FIGS. 7 to 9 are views showing a non-compatible shape discriminating member and an actuating member, FIG. 7 shows them before the main body is attached, FIG. 8 shows them in a way of process that the main body is attached and FIG. 9 shows them after the main body is attached. FIG. 10 is a view showing the actuating member, FIG. 11A is a sectional side view showing a first recess and FIG. 11B is a sectional side view showing a second recess.

The toner container attachment part 9 is divided from the image forming part and the sheet conveying path by a partition plate 21 (refer to FIGS. 7 to 9). The toner container attachment part 9 includes container holders 22 (refer to FIG. 4), non-compatible shape discriminating members 23 (refer to FIGS. 7 to 9) and actuating members 24 (refer to FIG. 10). The container holders 22 are adjacently arranged along the front and rear directions corresponding to the toner containers 10. The non-compatible shape discriminating member 23 is fixed on the partition plate 21 on a rear side of each container holder 22. The actuating members 24 are supported between the non-compatible shape discriminating members 23 and the partition plate 21.

Figure 4:
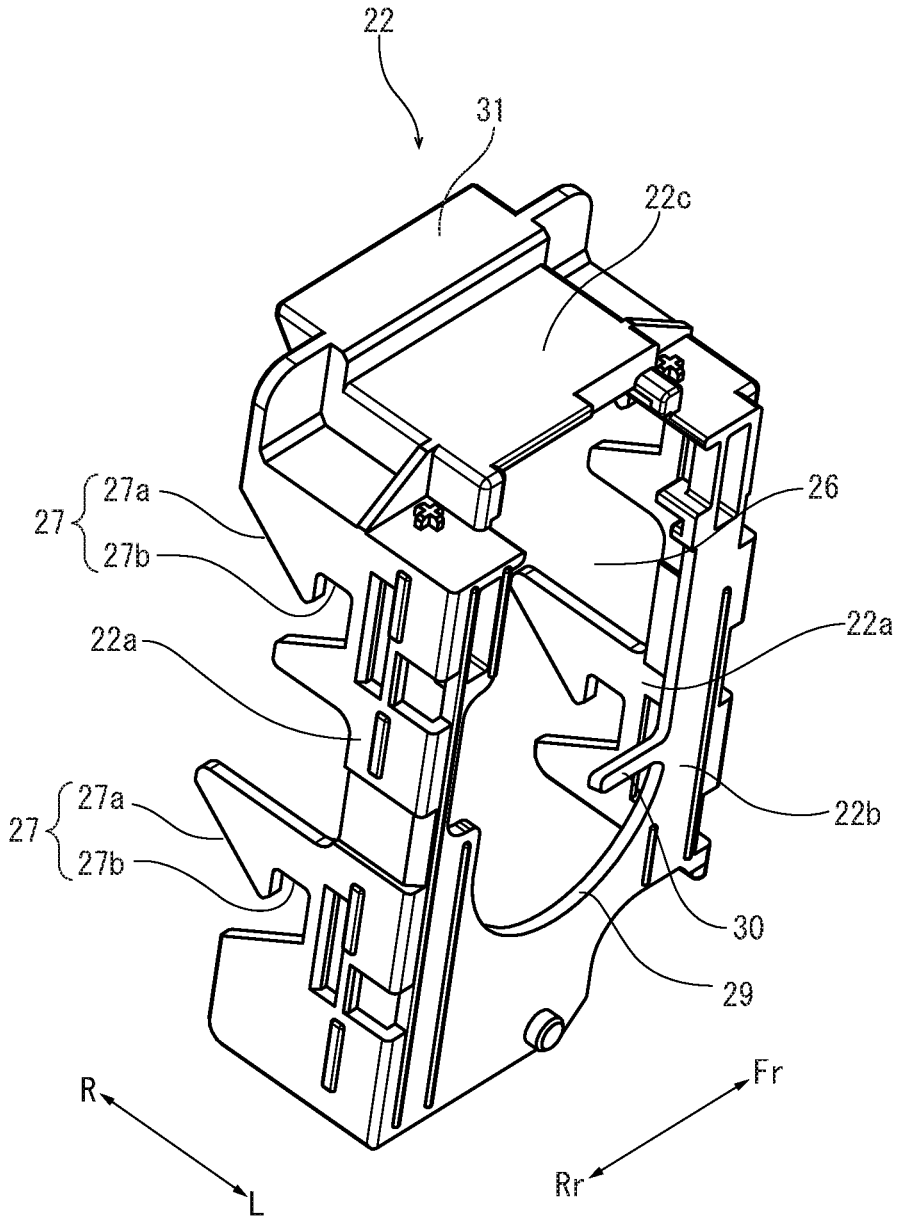
FIG. 4 is a perspective view showing a container holder, in the color printer according to the embodiment of the present disclosure.

With reference to FIG. 4, the container holder 22 will be described. The container holder 22 has side plates 22*a* opposing to each other in the front and rear directions, a rear plate 22*b* and an upper plate 22*c* which forms a parallelepiped hollow space 26 whose front face and lower face are opened. Along each side edge of each side plate 22*a*, two cutouts 27 are formed at a predetermined interval in the vertical direction. An upper edge of each cutout 27 has an inclined edge 27*a* inclined in an oblique lower direction from the side edge and a curved edge 27*b* curved upward from a lower end of the inclined edge 27*a*. The rear plate 22*b* has a vertical long rear opening 29. On an inner circumference of the rear opening 29, a projection piece 30 is horizontally protruded. The upper plate 22*c* has a grip piece 31 along its end edge.

The container holder 22 is supported so as to be movable upward and downward with the hollow space 26 facing the toner container attachment opening 2*a*. The container holder 22 is biased downward by a biasing member (not shown).

An attachment of the toner container 10 to the container holder 22 will be described with reference to FIGS. 5 and 6B. As show in FIG. 5, when the toner containing part 11*a* of the main body 11 of the toner container 10 is fitted into the hollow space 26 of the container holder 22, the bosses 14 protruded from the side faces of the toner containing part 11*a* enter the cutouts 27 formed in the side plates 22*a* of the container holder 22. Then, as shown in FIG. 6A, when the bosses 14 come in contact with the inclined edges 27*a* of the cutouts 27, the cutouts 27 are pushed upward by the bosses 14 and thus the container holder 22 is moved upward against the biasing force of the biasing member. Here, an attachment direction of the toner container 10 to the container holder 22 is shown by the attachment direction X.

Figure 6B:
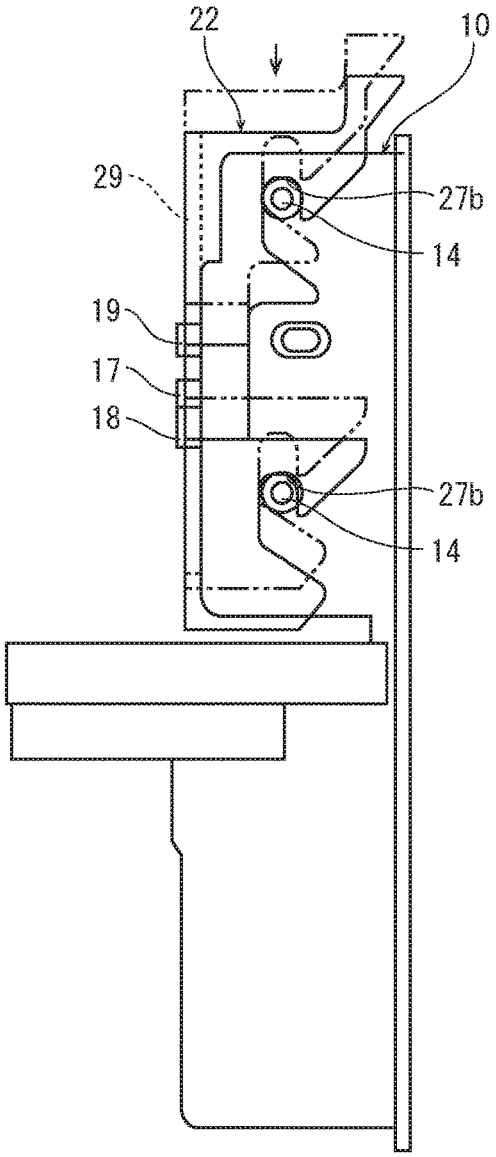
FIG. 6B is a side view showing the container holder after the toner container is attached, in the color printer according to the embodiment of the present disclosure.

When the toner container 10 is fitted into the hollow space 26 of the container holder 22 further in the attachment direction X, as shown in FIG. 6B, the bosses 14 are engaged with the curved edges 27*b* of the cutouts 27. When the bosses 14 are engaged with the curved edges 27*b*, the container holder 22 is moved downward by the biasing force of the biasing member. As described above, in a process that the toner container 10 is attached to the container holder 22, the container holder 22 is moved upward (refer to a solid line in FIG. 6A) and then downward (refer to a solid line in FIG. 6B). In addition, when the toner container 10 is attached to the container holder 22, the shaft 17, the first and second engagement projections 18 and 19 of the non-compatible shaped piece 12 are protruded through the rear opening 29 of the rear plate 22*b* of the container holder 22.

Next, with reference to FIGS. 7 to 9, the non-compatible shape discriminating member 23 will be described. The non-compatible shape discriminating member 23 has a circular dish shape. On a center of the non-compatible shape discriminating member 23, a circular center opening 32 is formed. The non-compatible shape discriminating member 23 has a first engagement hole 33 and a second engagement hole 34 with which the first engagement projection 18 and the second engagement projections 19 (refer to FIG. 3) can be respectively engaged.

Along an outer circumference of the non-compatible shape discriminating member 23, a substantial rectangular cutout 36 and a circumferential cutout 37 are formed.

The non-compatible shape discriminating member 23 is arranged corresponding to the rear opening 29 of each container holder 22 and, the outer circumference of the non-compatible shape discriminating member 23 is fixed on the partition plate 21. As shown in FIG. 7, the projection piece 30 of the container holder 22 enters the rectangular cutout 36 of the non-compatible shape discriminating member 23. When the container holder 22 is moved upward and downward as described above, the projection piece 30 is moved upward and downward within the rectangular cutout 36.

Next, with reference to FIGS. 10 and 11, the actuating member 24 will be described. The actuating member 24 has a disk shape smaller than the non-compatible shape discriminating member 23. On a center of the actuating member 24, a circular center opening 41 is formed. The actuating member 24 has a first recess 42 and a second recess 43 which respectively correspond to the first engagement hole 33 and the second engagement hole 34.

The first recess 42 has a fan shape that the first engagement hole 33 is enlarged in a circumferential direction of the actuating member 24. On both sides of the first recess 42 in the circumferential direction of the actuating member 24, a first tapered face 42*a* and a second tapered face 42*b* are formed in the order in the clockwise direction (shown by CW in each figure) in FIG. 10. As shown in FIG. 11A, the first tapered face 42*a* and the second tapered face 42*b* are inclined outward in the circumferential direction from a deep side toward a front side of the first recess 42. The first tapered face 42*a* and the second tapered face 42*b* are guide parts which guide the first engagement projection 18 in a direction in which the first engagement projection 18 is pushed out from the first engagement hole 33.

The second recess 43 has a fan shape that the second engagement hole 34 is enlarged in the circumferential direction of the actuating member 24. On both sides of the second recess 43 in the circumferential direction of the actuating member 24, a first tapered face 43*a* and a second tapered face 43*b* are formed in the order in the clockwise direction in FIG. 10. As shown in FIG. 11B, the first tapered face 43*a* and the second tapered face 43*b* are inclined outward in the circumferential direction from a deep side toward a front side of the second recess 43. The first tapered face 43*a* and the second tapered face 43*b* are guide parts which guides the second engagement projection 19 in a direction in which the second engagement projection 19 is pushed out from the second engagement hole 34.

As shown in FIG. 10, along a circumference of the actuating member 24, a cutout 45 and an extended piece 46 are formed. On the extended piece 46, a pin 47 is protruded.

The actuating member 24 is positioned with the center opening 41 aligning on the same axis of the center opening 32 of the non-compatible shape discriminating member 23, and supported in the space between the partition plate 21 and the non-compatible shape discriminating member 23 as described above. As shown in FIGS. 7 to 9, the extended piece 46 protrudes radially through the circumferential cutout 37 of the non-compatible shape discriminating member 23. A coil spring 35 that is a biasing member is interposed between the pin 47 of the extended piece 46 and the partition plate 21. The coil spring 35 biases the non-compatible shape discriminating member 23 to be rotated in the counterclockwise direction in FIGS. 7 to 9. As shown in FIG. 7, the extended piece 46 comes in contact with a side edge of the circumferential cutout 37 on the front side of the rotation direction when the actuating member 24 is rotated in the counterclockwise direction. An almost all portion of the second tapered face 42*b* of the first recess 42 is exposed through the first engagement hole 33 of the non-compatible shape discriminating member 23 (refer to a solid line in FIG. 11A). An almost all portion of the second tapered face 43*b* of the second recess 43 is exposed through the second engagement hole 34 of the non-compatible shape discriminating member 23 (refer to a solid line in FIG. 11B).

In addition, the projection piece 30 of the container holder 22 enters the cutout 45. The projection piece 30 is close to one side edge of the cutout 45 on the front side of the rotation direction of the actuating member 24 when the actuating member 24 is rotated in the clockwise direction.

Figure 12:
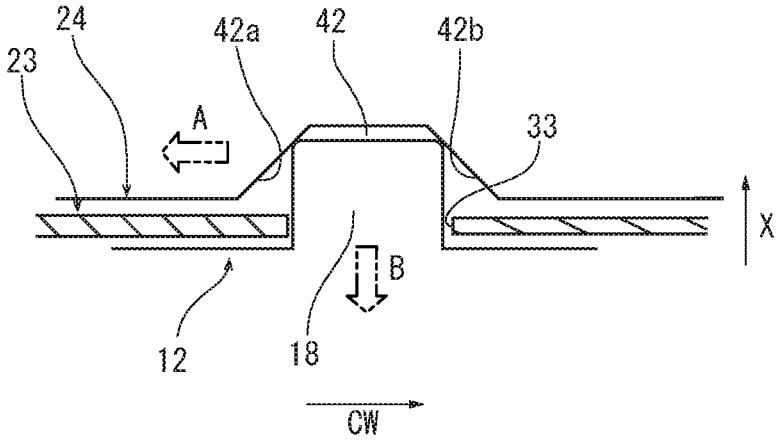
FIG. 12 is a sectional side view showing a first engagement projection engaged with a first engagement hole and entered the first recess, in the color printer according to the embodiment of the present disclosure.

In the color printer 1 having the above configuration, a non-compatible shape discriminating process of the toner container 10 in the toner container attachment part 9 will be described with reference to FIGS. 6 to 11B and FIG. 12. FIG. 12 is a view showing the actuating member rotated by the non-compatible shape discriminating member.

When the toner container 10 will be attached to the toner container attachment part 9, the toner containing part 11*a* of the toner container 10 is fitted into the hollow space 26 of the container holder 22. Then, in a process that the bosses 14 of the toner container 10 come into contact with the inclined edges 27*a* of the cutouts 27 of the container holder 22, the container holder 22 is moved upward as described above. In this time, the projection piece 30 of the container holder 22 is moved upward in the cutout 45 of the actuating member 24, comes in contact with the other side edge of the cutout 45, and then pushes the other side edge of the cutout 45 upward. This rotates the actuating member 24 in the clockwise direction against the biasing force of the coil spring 35, as shown in FIG. 8.

When the actuating member 24 is rotated in the clockwise direction, the first recess 42 reaches a substantial center of the first engagement hole 33 in the circumferential direction of the non-compatible shape discriminating member 23 (refer to a two-dotted line in FIG. 11A). And, the second recess 43 reaches a substantial center of the second engagement hole 34 in the circumferential direction of the non-compatible shape discriminating member 23 (refer to a two-dotted line in FIG. 11B).

In addition, the shaft 17 of the non-compatible shaped piece 12 of the toner container 10 is inserted into the center opening 41 of the actuating member 24 through the rear opening 29 of the container holder 22 and the center opening 32 of the non-compatible shape discriminating member 23. At the same time, the first and second engagement projections 18 and 19 are respectively engaged with the first and second engagement holes 33 and 34 of the non-compatible shape discriminating member 23 through the rear opening 29 of the container holder 22. After that, the first and second engagement projections 18 and 19 respectively enter the first and second recesses 42 and 43 of the actuating member 24, as shown in FIG. 12 (FIG. 12 shows the first engagement projection).

When the bosses 14 of the toner container 10 are engaged with the curved edges 27*b* of the cutouts 27 of the container holder 22, the container holder 22 is moved downward as described above, and the projection piece 30 is moved downward in the cutout 45 as shown in FIG. 9. This allows the coil spring 35 to bias the actuating member 24 so as to be rotated in the counterclockwise direction.

Then, the first and second engagement projections 18 and 19 which have respectively entered the first and second recesses 42 and 43 are respectively guided by the second tapered faces 42*b* and 43*b* of the first recess and second recesses 42 and 43 in the counterclockwise direction, as shown by a hollow arrow A in FIG. 12. That is, the first and second engagement projections 18 and 19 are guided so as to be respectively pushed out from the first and second engagement holes 33 and 34, as shown by a hollow arrow B in FIG. 12.

However, even if the non-compatible shaped piece 12 is guided so as to be pushed out from the non-compatible shape discriminating member 23, the main body 11 of the toner container 10 is completely attached to the container holder 22 so that the push out of the toner container 10 is prevented and the actuating member 24 is not rotated. That is, the engagement of the first and second engagement projections 18 and 19 with the first and second engagement holes 33 and 34 can be maintained. By engaging the non-compatible shaped piece 12 with the non-compatible shape discriminating member 23, the non-compatible shape discriminating member 23 discriminates that a normal toner container 10 is attached to the toner container attachment part 9.

As described above, according to the color printer 1 of the present disclosure, the toner container 10 is formed by the main body 11 and the non-compatible shaped piece 12 which are separated members. Accordingly, the main body 11 can be used in common for color printers of the same machine model regardless of the kinds of the toner container 10, and thus the productivity of the toner container 10 can be improved. In addition, information concerning the non-compatible shaped piece 12 is hardly leaked out so that effective countermeasure against imitation toner containers can be obtained.

In addition, the first and second engagement projections 18 and 19 of the non-compatible shaped piece 12 each have a fan shape around the center of the base part 16. Accordingly, by rotating the non-compatible shaped piece 12 around the center of the base part 16, a position (phase) of the first and second engagement projections 18 and 19 relative to the center of the base part 16 can be varied while keeping a relative position of the first and second engagement projections 18 and 19. That is, one non-compatible shaped piece 12 can produce a plurality of non-compatible shapes. Therefore, the non-compatible shaped piece 12 can be also used in common. This further improves the productivity of the toner container 10. In this case, the first and second engagement holes 33 and 34 of the non-compatible shape discriminating member 23 are formed so as to correspond to the first and second engagement projections 18 and 19 which have been varied in phase.

In addition, the non-compatible shape is discriminated whether or not the first and second engagement projections 18 and 19 are respectively engaged with the first and second engagement holes 33 and 34. Accordingly, the non-compatible shape can be discriminated by easy and secure way. In a case where it is necessary to discriminate the non-compatible shape only, the first and second engagement projections 18 and 19 are formed in the non-compatible shape discriminating member 23 and the first and second engagement holes 33 and 34 are formed in the non-compatible shaped piece 12.

Figure 14A:
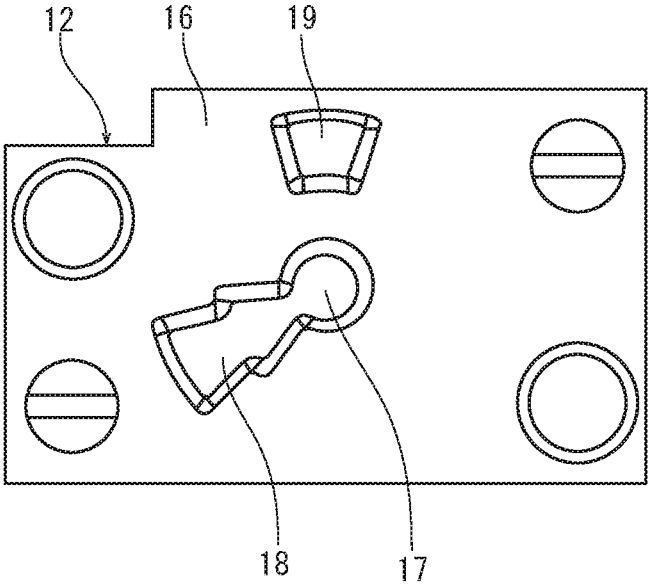
FIG. 14A is a front view showing another type of the non-compatible shaper part, in the color printer according to the embodiment of the present disclosure.
Figure 14B:
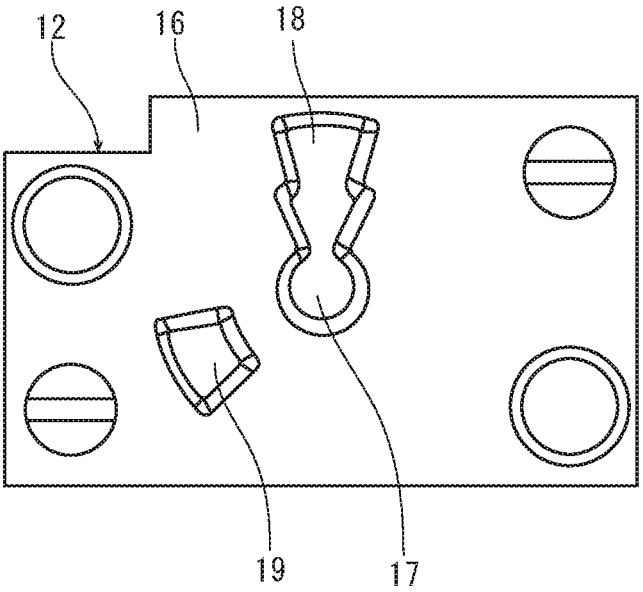
FIG. 14B is a front view showing still another type of the non-compatible shaper part, in the color printer according to the embodiment of the present disclosure.

A shape of the non-compatible shaped piece 12 is not limited to the shape of the present embodiment. For example, as shown in FIGS. 14A and 14B, the base part 16 may be formed into a rectangular shape or a relative position of the first and second engagement projections 18 and 19 may be reversed. Alternatively, the shape of the engagement projection may be varied or a number of the engagement projection may be one or three or more. However, as described above, the non-compatible shaped piece 12 preferably has the circular base part 16 and the first and second engagement projections 18 and 19 each having a fan shape around the center of the base part 16 because one non-compatible shaped pieces 12 can produce a plurality of non-compatible shapes.

In the present embodiment, the actuating member 24 is configured so as to rotate around the center of the base part 16 as the container holder 22 is moved upward and downward. This can rotate the actuating member 24 within an area of an attachment space of the actuating member 24 so that the attachment space of the actuating member 24 can be small. However, the actuating member 24 may be slid linearly. In addition, in the present embodiment, the first and second tapered faces 42*a* and 42*b* are formed on both sides in the circumferential direction of the first recess 42, and the first and second tapered faces 43*a* and 43*b* are formed on both sides in the circumferential direction of the second recess 43. Thus, when the actuating member 24 is rotated in the clockwise direction or the counterclockwise direction, either one of the tapered faces guides the first and second engagement projections 18 or 19 in a direction pushed out from the first and second recesses 42 or 43. Accordingly, by the rotating of the actuating member 24, the first and second engagement projections 18 and 19 can be guided in the direction pushed out from the first and second recesses 42 and 43 smoothly.

By the way, in a consumable such as the toner container 10, an imitation may be sometimes distributed. In the toner container 10 of the present disclosure, the non-compatible shaped piece 12 may be imitated. As described above, in a case of the normal toner container 10, the non-compatible shaped pieces 12 is previously assembled to the main body 11 so as to be capable of engaging with the non-compatible shape discriminating member 23. However, in a case of the imitation toner container, because the shape (a position of the first and second engagement holes 33 and 34) of the non-compatible shape discriminating member 23 which has been attached to the toner container attachment part 9 is hardly known previously, it is difficult to assemble the non-compatible shaped piece 12 to the main body 11 so as to be capable of engaging with the non-compatible shape discriminating member 23.

Figure 13A:
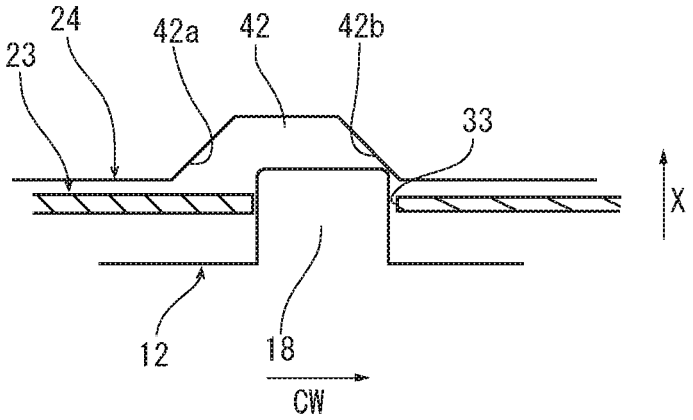
FIG. 13A is a sectional side view showing the first engagement projection in a middle of entering the first recess, in the color printer according to the embodiment of the present disclosure.
Figure 13B:
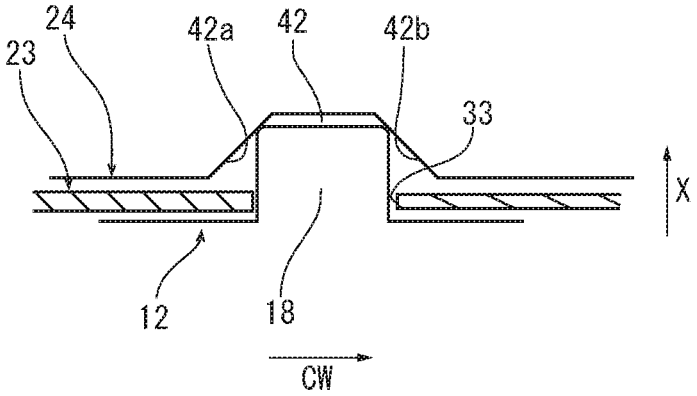
FIG. 13B is a sectional side view showing the first engagement projection entered the first recess, in the color printer according to the embodiment of the present disclosure.
Figure 13C:
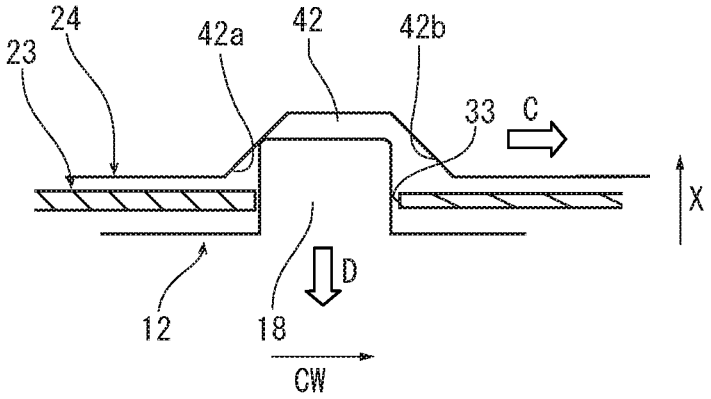
FIG. 13C is a sectional side view showing the first engagement projection pushed out from the first recess by a guide part of the first recess, in the color printer according to the embodiment of the present disclosure.

However, the non-compatible shaped piece 12 alone can be easily engaged with the non-compatible shape discriminating member 23 by rotating the non-compatible shaped piece 12 around the center of the non-compatible shape discriminating member 23 by a predetermined angle. That is, the imitation toner container may be attached by a non-normal way. For example, the non-compatible shaped piece 12 alone is previously attached to the non-compatible shape discriminating member 23 and then the main body 11 is attached to the container holder 22. An attachment of the imitation toner container to the toner container attachment part 9 in this case will be described with reference to FIGS. 13A to 13C. FIGS. 13A to 13C are views showing the actuating member rotated by the non-compatible shaped piece (FIGS. 13A to 13C shows the first engagement projection 18 only).

When the non-compatible shaped piece 12 is engaged with the non-compatible shape discriminating member 23 and then the first and second engagement projections 18 and 19 respectively enter the first and second recesses 42 and 43 of the actuating member 24, as shown in FIG. 13A, tips of the first and second engagement projections 18 and 19 respectively abut against the second tapered faces 42*b* and 43*b* of the first and second recess 42 and 43. Then, the actuating member 24 is rotated in the clockwise direction against the biasing force of the coil spring 35.

After the first and second engagement projections 18 and 19 has been respectively entered the first and second recesses 42 and 43 (refer to FIG. 13B), the main body 11 of the toner container 10 will be attached to the container holder 22. As described above, the toner container 10 is moved upward in the process that the main body 11 is attached to the container holder 22 (refer to FIG. 6). When the container holder 22 is moved upward, the cutout 45 is pushed upward by the projection piece 30 and the actuating member 24 is further rotated in the clockwise direction as shown a hollow arrow C in FIG. 13C.

Then, the first and second tapered faces 42*a* and 43*a* of the actuating member 24 respectively abut against the first and second engagement projections 18 and 19, and then respectively guide the first and second engagement projections 18 and 19 in a direction pushed out from the first and second engagement holes 33 and 34, as shown in an hollow arrow D. At this time, because the main body 11 is not attached to the container holder 22 completely, the non-compatible shaped piece is easily pushed out from the non-compatible shape discriminating member 23.

As described above, even if it becomes possible to engage the non-compatible shaped piece 12 with the non-compatible shape discriminating member 23, the engagement is released in the process that the main body 11 is attached to the container holder 22. Accordingly, it becomes impossible to attach the toner container 10 to the toner container attachment part 9 by the non-normal way in which the non-compatible shaped piece 12 is previously engaged with the non-compatible shape discriminating member 23 and then the main body 11 is attached to the container holder 22. Accordingly, as long as the non-compatible shaped piece 12 is engaged with the non-compatible shape discriminating member 23 and the main body 11 is completely attached to the container holder 22, the toner container 10 cannot be attached to the toner container attachment part 9.

If the information concerning the shape of the non-compatible shaped piece 12 may be leaked out, when the non-compatible shaped piece 12 is assembled to the main body 11 in-house, distribution of the imitation toner container can be prevented. This is because the information of the positional relationship of the non-compatible shaped piece 12 and the main body 11 is hardly leaked out.

Figure 15:
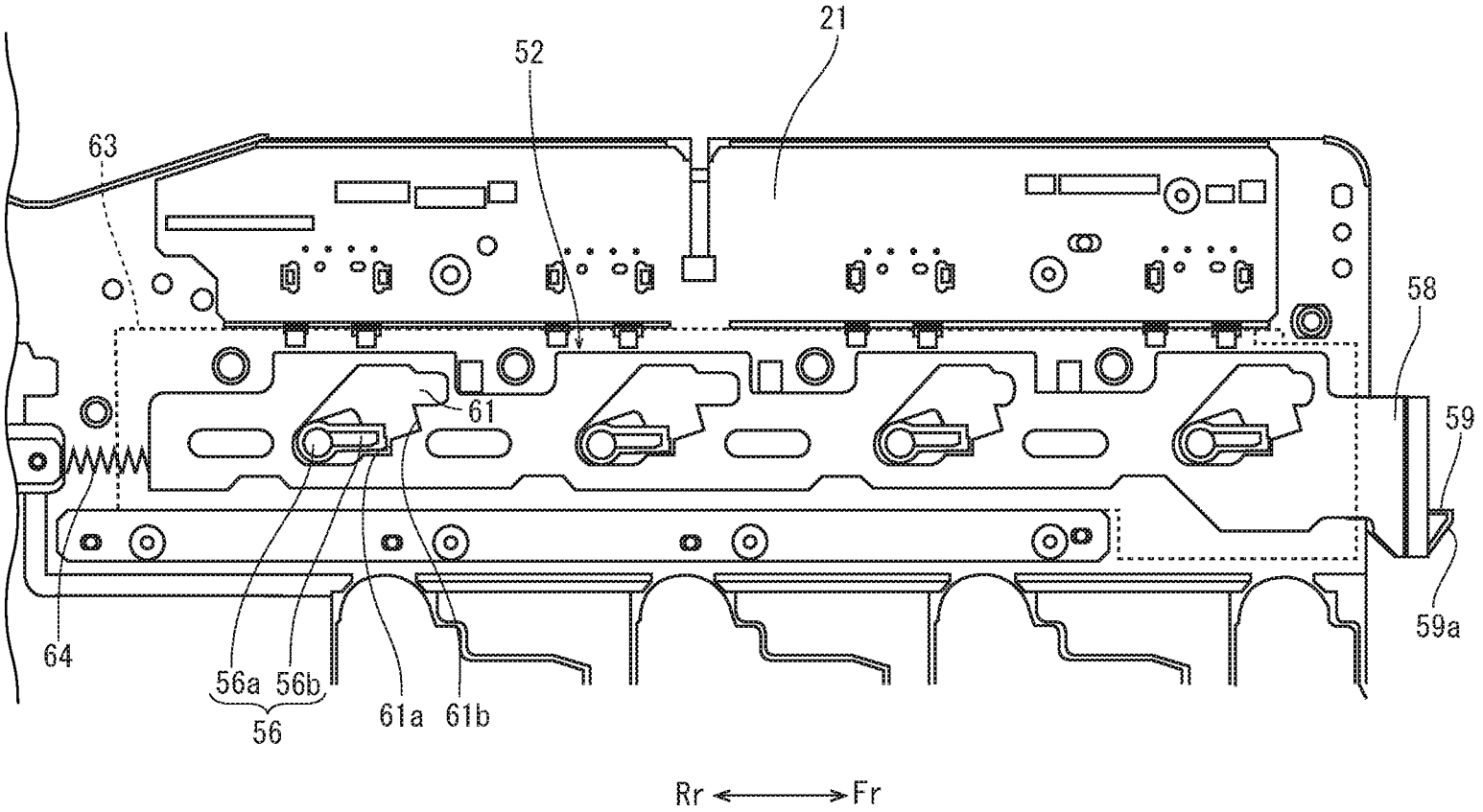
FIG. 15 is a front view showing a movable bar before rotating of the actuating member, in the color printer according to another embodiment of the present disclosure.
Figure 16:
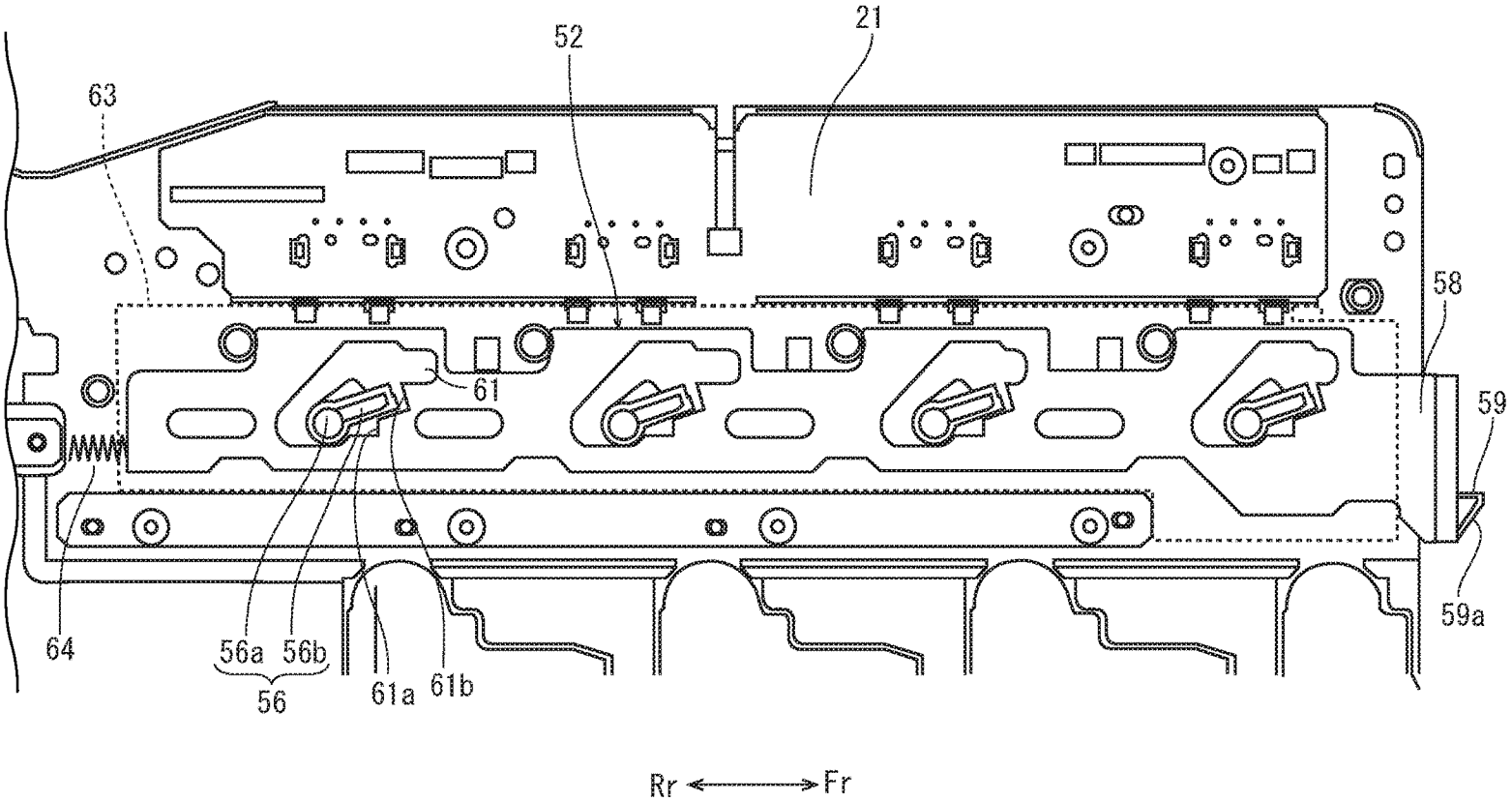
FIG. 16 is a front view showing the movable bar after rotating of the actuating member, in the color printer according to another embodiment of the present disclosure.
Figure 17:
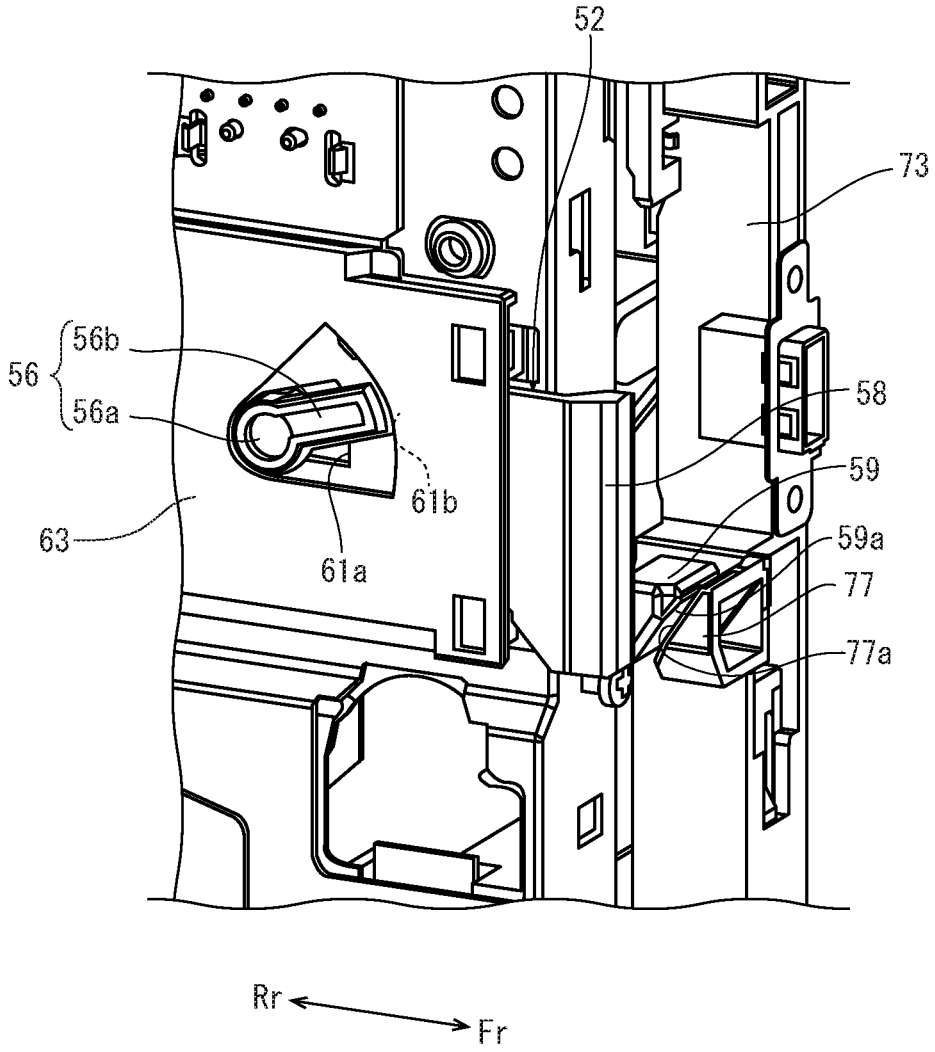
FIG. 17 is a front view showing the movable bar and a switching member, in the color printer according to another embodiment of the present disclosure.

Next, an another example of the toner container attachment part 9 will be described with reference to FIG. 2 and FIGS. 15 to 19B. FIGS. 15 and 16 are views showing a movable bar, FIG. 17 is a perspective view showing a front end of the movable bar, FIGS. 18A and 18B are perspective views showing the switching member and FIGS. 19A and 19B are perspective views showing a vertical slide member and a second switching member.

The toner container attachment part 9 of the example is provided with a detection mechanism which detects whether the toner container 10 is correctly attached or not. The detection mechanism includes a detection device 51 (refer to FIG. 2), a movable bar 52 (refer to FIGS. 15 and 16) and a switching member 53 (refer to FIGS. 18A to 19B). The detection device 51 is disposed in the toner container attachment opening 2*a*. The movable bar 52 is supported on a rear side face (a left side face in the figure) of the partition plate 21 slidably in the front and rear directions. The switching member 53 is interposed between the movable bar 52 and the cover 6, and the detection device 51.

The detection device 51 is a push type sensor having a push-in switch 51*a* projectable downward. When the push-in switch 51*a* is pushed in, the detection device 51 is switched into a first state detecting that the toner container 10 is attached. When the push-in switch 51*a* is released from the push-in, the detection device 51 is switched into a second state detecting that the toner container 10 is not attached. The detection device 51 is electrically connected to the control part. When the push-in switch 51*a* is pushed in to switch the detection device 51 into the first state, the switching is transmitted to the control part and the control part decides that the color printer 1 is capable of an image forming. When the push-in switch 51*a* is released from the push-in and the detection device 51 is switched into the second state, the switching is transmitted to the control part and the control part decides that the color printer 1 is not capable of an image forming.

Figure 18A:
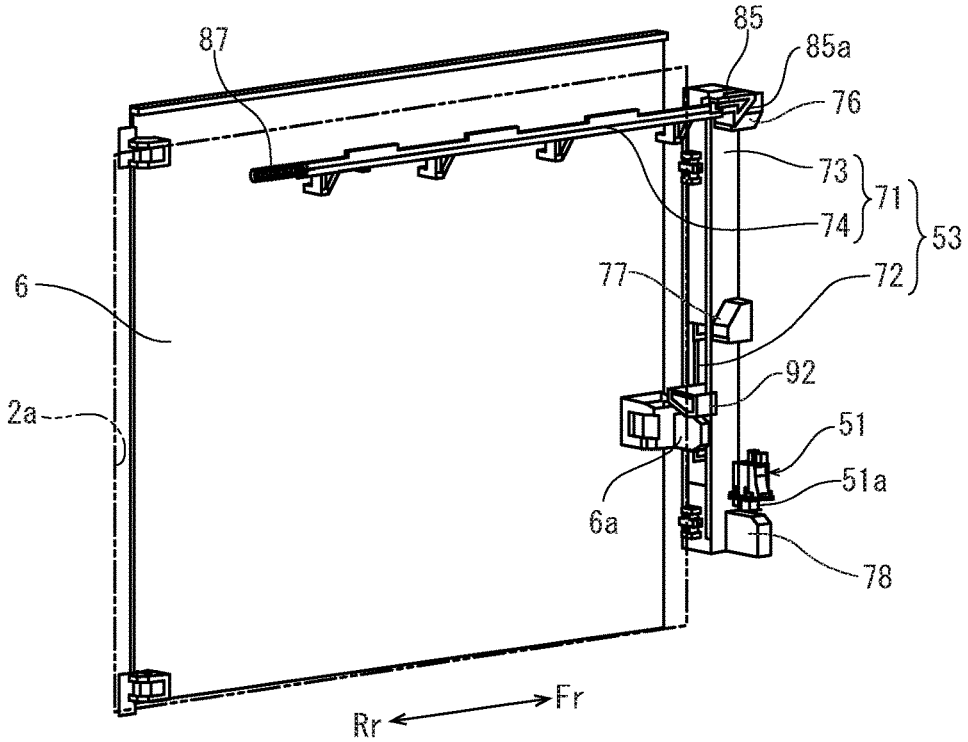
FIG. 18A is a perspective view showing the switching member viewed from a rear side of a cover, in the color printer according to another embodiment of the present disclosure.
Figure 18B:
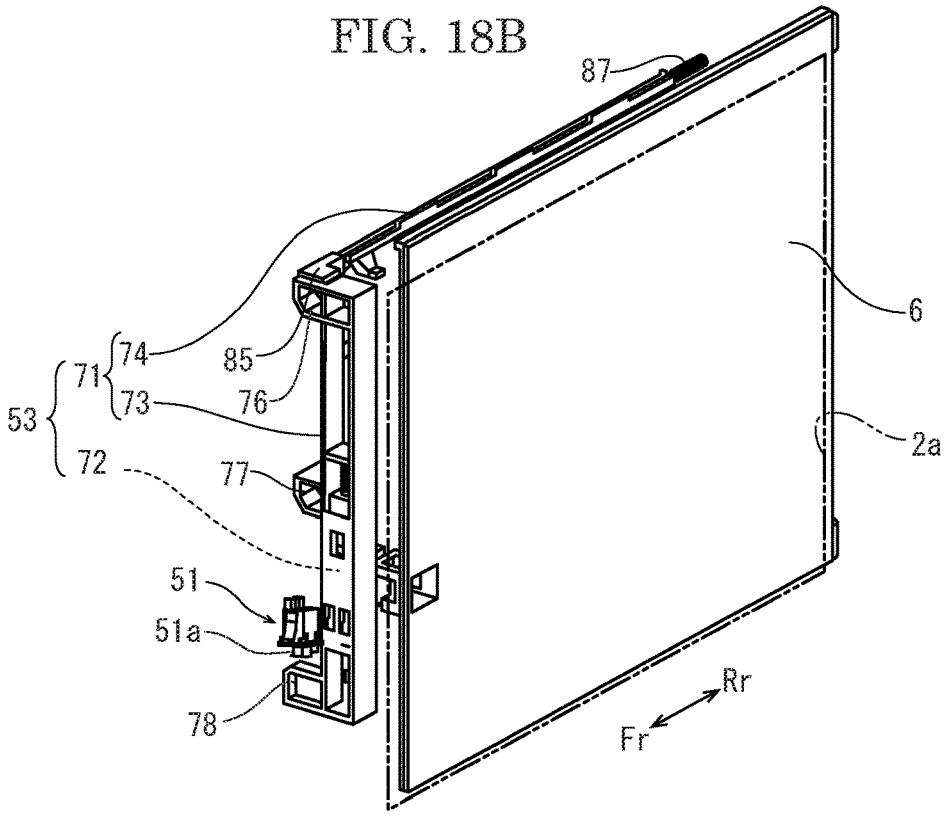
FIG. 18B is a perspective view showing the switching member viewed from a front side of the cover, in the color printer according to another embodiment of the present disclosure.
Figure 19A:
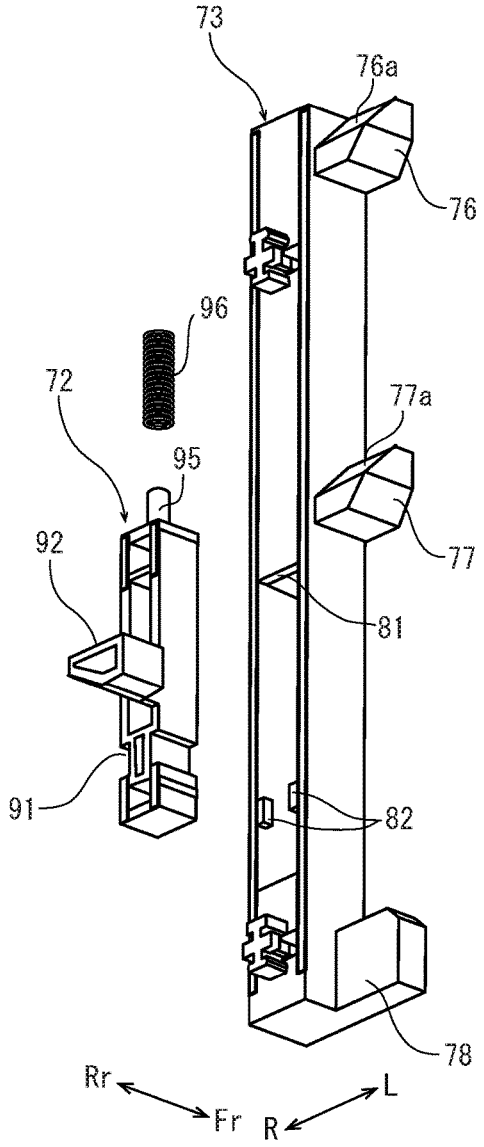
FIG. 19A is a perspective view showing a second switching member and a vertical slide member viewed from the front side of the cover, in the color printer according to another embodiment of the present disclosure.
Figure 19B:
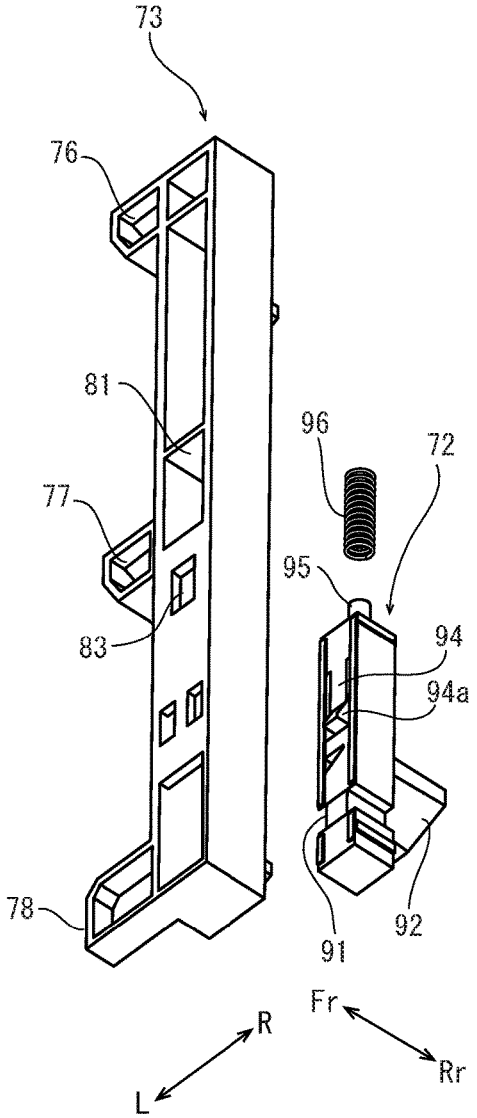
FIG. 19B is a perspective view showing the second switching member and the vertical slide member viewed from the front side of the cover, in the color printer according to another embodiment of the present disclosure.

The detection device 51 is disposed at near a front lower corner of the toner container attachment opening 2*a* with the push-in switch 51*a* downward, as shown in FIGS. 2, 18A and 18B.

Next, the movable bar 52 will be described with reference to FIGS. 15 and 16. The movable bar 52 is configured to be switchable between two states (a switching possible state and a switching impossible state) as described later, as the actuating member 24 is rotated.

The actuating member 24 of this example will be described. As shown in FIGS. 15 to 17, the actuating member 24 has a protruding part 56. The protruding part 56 protrudes from a rear side face (a left side face in the figure) of the actuating member 24 rearward (leftward) through a through opening (not shown) of the partition plate 21. The protruding part 56 has a shaft portion 56*a* on the same axis as the center opening 41 of the actuating member 24 and a restriction portion 56*b* extending radially from the shaft portion 56*a*. When the non-compatible shaped piece 12 is engaged with the non-compatible shape discriminating member 23 to rotate the actuating member 24, the restriction portion 56*b* is turned around the shaft portion 56*a* from a horizontal posture (refer to FIG. 15) extending forward into an inclined posture (refer to FIG. 16) extending obliquely in an upper front direction.

As shown in FIGS. 15 and 16, the movable bar 52 is a horizontal long plate member. The movable bar 52 has a lever piece 58 extending forward from a front edge of the movable bar 52. From a front face of the lever piece 58, a pressed part 59 is protruded forward. The pressed part 59 has an inclined front face 59*a* inclined downward in an oblique front direction. As shown in FIGS. 15 to 17, the movable bar 52 has openings 61 where the protruding parts 56 of the actuating members 24 enter through the through openings of the partition plate 21. The opening 61 has a first restriction edge 61*a* and a second restriction edge 61*b* which are adjacently arranged. The second restriction edge 61*b* is formed in front of the first restriction edge 61*a*. Each of the first restriction edge 61*a* and the second restriction edge 61*b* can face a front edge of the restriction portion 56*b*.

The movable bar 52 is supported to the partition plate 21 by a guide plate 63 so as to be slidable in the front and rear directions. The movable bar 52 is biased forward by a biasing member 64. As shown in FIG. 15, when the actuating member 24 is not rotated and the restriction portion 56*b* of the protruding part 56 is turned into the horizontal posture, the front edge of the restriction portion 56*b* faces the first restriction edge 61*a* of the opening 61. Then, if the movable bar 52 may slide rearward, the front edge of the restriction portion 56*b* comes into contact with the first restriction edge 61*a* to prevent the movable bar 52 from sliding rearward. On the other hand, when the actuating member 24 is rotated and the restriction portion 56*b* of the protruding part 56 is turned into the inclined posture, as shown in FIG. 16, the front edge of the restriction portion 56*b* separates from the first restriction edge 61*a* and then faces the second restriction edge 61*b*. This permits the movable bar 52 to slide rearward against the biasing force of the biasing member 64.

Next, the switching member 53 will be described with reference to FIGS. 18A to 19B. The switching member 53 has a first switching member 71 interposed between the detection device 51 and the movable bar 52 and a second switching member 72 interposed between the first switching member 71 and the cover 6.

As shown in FIGS. 18A and 18B, the first switching member 71 has a vertical slide member 73 and a horizontal slide member 74. The vertical slide member 73 is supported slidably along a front edge of the toner container attachment opening 2*a* in the vertical direction. The horizontal slide member 74 is supported slidably along an upper edge of the toner container attachment opening 2*a* in the left and right directions.

The vertical slide member 73 is a hollow square cylindrical shape member long in the vertical direction. As shown in FIG. 19A, on a left face of the vertical slide member 73, an upper pressing part 76, a center pressing part 77 and a lower pressing part 78 are protruded. The upper pressing part 76 has an inclined rear face 76*a* inclined in the upper rear direction. The center pressing part 77 has an inclined rear face 77*a* inclined in the upper rear direction. As shown in FIG. 17, the inclined rear face 77*a* of the center pressing part 77 is positioned to face the inclined front face 59*a* of the pressed part 59 of the lever piece 58 of the movable bar 52. The lower pressing part 78 has a rectangular parallelepiped shape having a thin thickness in the front and rear direction. The lower pressing part 78 has a tapered face at its upper corner. As shown in FIGS. 18A and 18B, the lower pressing part 78 is positioned under the push-in switch 51*a* of the detection device 51 at a predetermined interval.

The vertical slide member 73 is divided into an upper hollow portion and a lower hollow portion by a partition wall 81 as shown in FIG. 19A. A rear face of the lower hollow portion is opened. On both side edges of the lower hollow portion, a pair of projection pieces 82 opposing to each other are formed. As shown in FIG. 19B, on a front face of the lower hollow portion, an opening 83 is formed.

The horizontal slide member 74 is a plate piece long in the front and rear directions, as shown in FIGS. 18A and 18B. On a front end of the horizontal slide member 74, a front pressing part 85 is formed. The front pressing part 85 has an inclined front face 85*a* inclined in the lower front direction. The horizontal slide member 74 is biased forward by a coil spring 87 such that the inclined front face 85*a* of the front pressing part 85 comes into contact with the inclined rear face 76*a* of the upper pressing part 76 of the vertical slide member 73.

The second switching member 72 is a square cylindrical shape member having a length shorter than a length of the lower hollow portion of the vertical slide member 73, as shown in FIGS. 19A and 19B. The second switching member 72 has a narrow portion 91 having a narrow width in the left and right directions at its lower end portion. On a center of a rear face of the second switching member 72, a pressed part 92 is protruded. As shown in FIG. 19B, on an upper portion of a front face of the second switching member 72, an elastic piece 94 deformable around its upper end is formed. At a front end of a front face of the elastic piece 94, a tapered claw 94*a* is formed. On an upper end face of the second switching member 72, a pin 95 is protruded.

When the narrow portion 91 of the second switching member 72 is passed through a space between the pair of projection pieces 82 and then the claw 94*a* of the elastic piece 94 is engaged with the opening 83, the second switching member 72 is stored in the lower hollow portion of the vertical slide member 73. The second switching member 72 is slidable in the vertical direction in the lower hollow portion while preventing falling from the lower hollow portion by the pair of projection pieces 82.

Between the second switching member 72 and the partition wall 81, a coil spring 96 fitted onto the pin 95 is interposed. The coil spring 96 biases the second switching member 72 downward. Biasing force of the coil spring 96 is higher than biasing force of the coil spring 87 which biases the horizontal slide member 74 forward.

In the detecting mechanism having the above described configuration, an operation of the detection device 51 that detects whether or not the toner container 10 is property attached to the toner container attachment part 9 will be described with reference to FIGS. 15 to 19B.

In a state where the actuating member 24 is not rotated before the toner container 10 is attached to the toner container attachment part 9, as shown in FIG. 15, the restriction portion 56*b* of the protruding part 56 is turned into the horizontal posture. The front edge of the restriction portion 56*b* comes into contact with the first restriction edge 61*a* of the opening 61 of the movable bar 52 to restrict the movable bar 52 from sliding rearward.

In addition, the inclined front face 59*a* of the pressed part 59 of the movable bar 52 comes into contact with the inclined rear face 77*a* of the center pressing part 77 of the vertical slide member 73. Because the movable bar 52 is restricted from sliding rearward as described above, when the inclined front face 59*a* of the pressed part 59 comes into contact with the inclined rear face 77*a* of the center pressing part 77, the vertical slide member 73 is restricted from sliding upward. That is, the vertical slide member 73 is restricted from sliding in a direction in which the push-in switch 51*a* of the detection device 51 is pushed in. In other words, the detection device 51 is restricted from being switched from the second state into the first state. As described above, the movable bar 52 is in a switching impossible state.

When the toner container 10 is property attached to the toner container attachment part 9 to rotate the actuating member 24, as shown in FIG. 16, the restriction portion 56*b* of the protruding part 56 is turned from the horizontal posture into the inclined posture such that the front edge of the restriction portion 56*b* faces the second restriction edge 61*b* of the opening 61. Thus, the movable bar 52 switched into a state slidable rearward against the biasing force of the biasing member 64 (a switching possible state).

Next, when the cover 6 is closed, the pressing piece 6*a* of the cover 6 comes into contact with the pressed part 92 of the second switching member 72. Then, the pressed part 92 is pressed upward and the vertical slide member 73 in which the second switching member 72 is stored is applied with force in the upper direction. In addition, because the inclined rear face 76*a* of the upper pressing part 76 of the vertical slide member 73 comes into contact with the inclined front face 85*a* of the front pressing part 85 of the horizontal slide member 74, the inclined front face 85*a* is applied with force in the rear direction.

Because the biasing force of the coil spring 96 which biases the second switching member 72 is larger than the biasing force of the coil spring 87 which biases the horizontal slide member 74 forward, when the pressed part 92 of the second switching member 72 is pressed upward by the pressing piece 6*a* of the cover 6, the coil spring 96 which biases the second switching member 72 is not compressed but the coil spring 87 which biases the horizontal slide member 74 is compressed preferentially. As a result, the horizontal slide member 74 slides rearward and the vertical slide member 73 becomes a state slidable upward together with the second switching member 72.

On the other hand, because the movable bar 52 is in the state slidable rearward, when the vertical slide member 73 slides upward and the inclined rear face 77*a* of the center pressing part 77 presses the inclined front face 59*a* of the pressed part 59 of the movable bar 52, as shown in FIG. 14, the movable bar 52 slides leftward against the biasing force of the biasing member 64. Then, the vertical slide member 73 slides upward and then the push-in switch 51*a* of the detection device 51 is pushed in by the lower pressing part 78. This switches the detection device 51 into the first state.

As described above, when all of the toner containers 10 are property attached to the toner container attachment part 9 and then the toner container attachment part 9 is covered with the cover 6, the detection device 51 is switched into the first state and then the control part decides that the color printer 1 is capable of an image forming.

Here, a case where the toner container 10 having no non-compatible shaped piece 12, that is, the main body 11 alone may be attached to the container holder 22 will be described. The container holder 22 is moved upward in the process that the main body 11 is attached and then moved downward after the main body 11 is completely attached. When the container holder 22 is moved upward, as described above, the actuating member 24 is rotated in the clockwise direction in FIGS. 7 to 9 to turn the protruding part 56 into the inclined posture (refer to FIG. 16) from the horizontal posture. This permits the movable bar 52 to slide rearward so that the vertical slide member 73 is permitted to slide upward. However, because the container holder 22 is moved downward after the main body 11 is completely attached, the actuating member 24 is biased by the coil spring 35 in the counterclockwise direction in FIGS. 7 to 9 to turn the protruding part 56 into the horizontal posture (refer to FIG. 15) from the inclined posture. As a result, the rearward moving of the movable bar 52 is restricted again.

Accordingly, if the imitation toner container, such as the toner container having no non-compatible shaped piece 12, may be attached to the toner container attachment part 9, the detection device 51 cannot be switched into the first state so that the control part does not decides that the color printer 1 is capable of an image forming.

When either one of the toner containers 10 is not attached to the toner container attachment part 9, the actuating member 24 corresponding to the toner container 10 is not rotated to restrict the movable bar 52 from sliding rearward. If the toner container attachment opening 2*a* is closed with the cover 6 under such a situation where either one of the toner containers 10 is not attached, the vertical slide member 73 will be slid upward together with the second switching member 72 as described above. However, because the movable bar 52 is restricted from being moved rearward, the pressed part 59 of the movable bar 52 comes in contact with the center pressing part 77 of the vertical slide member 73 and, therefore, the vertical slide member 73 is restricted from being slid upward. Accordingly, the push-in switch 51*a* of the detection device 51 is not pushed in, and the detection device 51 is not switched into the first state.

However, even if the upward sliding of the vertical slide member 73 is restricted, because the pressed part 92 of the second switching member 72 is pressed upward by the pressing piece 6*a* of the cover 6, the second switching member 72 slides upward relative to the vertical slide member 73 against the biasing force of the coil spring 96. The second switching member 72 slides upward until the toner container attachment opening 2*a* is completely closed with the cover 6.

As described above, when either one of the toner containers 10 is not attached, even if the toner container attachment opening 2*a* is closed with the cover 6, the detection device 51 is not switched into the first state. That is, information showing that either one of the toner containers 10 is not attached is transmitted to the control part from the detection device 51. The control part decides that the color printer 1 is not capable of an image forming so that the image forming is not carried out.

However, even if either one of the toner containers 10 is not attached, the toner container attachment opening 2*a* can be closed with the cover 6 without switching the detection device 51 into the first state. For example, for maintenance, in a case where the color printer 1 requires to be transferred with the toner containers 10 not attached, if the toner container attachment opening 2*a* cannot be closed with the cover 6 unless the toner containers 10 are attached, it is difficult to handle the color printer 1 with the cover 6 opened. However, in the present embodiment, even if the toner containers 10 are not attached, because the toner container attachment opening 2*a* can be closed with the cover 6 without switching the detection device 51 into the first state, the handling the color printer 1 becomes easy.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

an attachment part to which a toner container is detachably attached, wherein the toner container includes a main body in which a toner is contained; and a non-compatible shaped piece capable of being assembled into the main body and having a shape different for each kind of the toner container, the attachment part includes a non-compatible shape discriminating member capable of engaging with the non-compatible shaped piece, wherein the non-compatible shaped piece has a circular base part and a discriminated part formed on the base part, and the non-compatible shape discriminating member has a discriminating part capable of engaging with the discriminated part, wherein the attachment part has a container holder to which the main body can be supported, the container holder being movable in a process that the main body is attached, and an actuating member movable as the container holder is moved, wherein when the non-compatible shaped piece is previously engaged with the non-compatible shape discriminating member and then the main body is attached to the container holder, the container holder is moved so as to move the actuating member in a direction in which the engagement of the non-compatible shaped piece and the non-compatible shape discriminating member is released and to release the engagement of the non-compatible shaped piece and the non-compatible shape discriminating member, and when the main body to which the non-compatible shaped piece is assembled is attached to the container holder, the moving of the actuating member in the direction in which the engagement of the non-compatible shaped piece and the non-compatible shape discriminating member is released is restricted by the main body supported to the container holder.

2. The image forming apparatus according to claim 1, wherein the actuating member is rotatable around a center of the base part as the container holder is moved.

3. The image forming apparatus according to claim 2, wherein the discriminated part is an engagement projection; and the discriminating part is an engagement hole with which the engagement projection is engaged, and wherein the actuating member has a recess where the engagement projection enters; and a guide part which guides the engagement projection so as to be pushed out from the recess in a direction in which an engagement of the engagement projection with the engagement hole is released.

4. The image forming apparatus according to claim 3, wherein the guide part has a first tapered face and a second tapered face which are inclined from a deep side toward a front side of the recess outward from both sides of the recess in a rotation direction of the actuating member.

5. The image forming apparatus according to claim 4, wherein the container holder is configured to support the main body after moving upward and then moving downward in the process that the main body is attached and, the actuating member is configured to be rotated in one direction when the container holder is moved upward and is rotated in the other direction opposing to the one direction when the container holder is moved downward.

6. The image forming apparatus according to claim 5, wherein in a state where the engagement projection enters the recess, when the container holder is moved upward to rotate the actuating member in the one direction, the first tapered face guides the engagement projection in a direction in which the engagement projection is pushed out from the recess, when the container holder is moved downward to rotate the actuating member in the other direction, the second tapered face guides the engagement projection in the direction in which the engagement projection is pushed out from the recess.

7. The image forming apparatus according to claim 5 comprising a biasing member which biases the actuating member in the other direction.

8. The image forming apparatus according to claim 6, wherein when the non-compatible shaped piece is previously engaged with the non-compatible shape discriminating member and then the main body is attached to the container holder, the container holder is moved upward to rotate the actuating member in the one direction and then the first tapered face guides the engagement projection in the direction in which the engagement projection is pushed out from the recess.

9. The image forming apparatus according to claim 3, wherein the engagement projection has a fan shape around the center of the base part.

10. The image forming apparatus according to claim 1 comprising:

a detection device switchable into a first state detecting that the toner container is attached to the attachment part and into a second state detecting that the toner container is not attached to the attachment part;

a switching member movable so as to switch the detection device into the first state and into the second state; and a movable bar switchable as the actuating member is moved, the movable bar being switched into a switching possible state where the switching member is permitted to be moved in a direction in which the detection device is switchable from the second state into the first state and into an switching impossible state where the switching member is restricted to be moved, wherein when the actuating member is moved as the container holder is moved, the movable bar is switched from the switching impossible state into the switching possible state.

* * * * *